US011591947B1

(12) United States Patent
Schumaker et al.

(10) Patent No.: US 11,591,947 B1
(45) Date of Patent: Feb. 28, 2023

(54) SYSTEMS AND METHODS FOR OPERATING AN ENGINE INCLUDING A SECONDARY AIR SYSTEM

(71) Applicant: Ford Global Technologies, LLC, Dearborn, MI (US)

(72) Inventors: Joshua Schumaker, Dearborn, MI (US); Andrew Bagnasco, Plymouth, MI (US); Adam Joseph Krach, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/650,048

(22) Filed: Feb. 4, 2022

(51) Int. Cl.
*F01N 3/22* (2006.01)
*F01N 9/00* (2006.01)

(52) U.S. Cl.
CPC ..... *F01N 3/22* (2013.01); *F01N 9/005* (2013.01)

(58) Field of Classification Search
CPC ..... F01N 2550/14; F01N 3/22; F01N 3/30; F01N 3/20; F02B 37/013; F02B 37/04; F02B 37/168; F02M 35/10386
See application file for complete search history.

(56) References Cited

U.S. PATENT DOCUMENTS

| | | | | |
|---|---|---|---|---|
| 8,863,497 | B1 | 10/2014 | Legare | |
| 10,443,475 | B2 * | 10/2019 | Lipa | F01N 3/225 |
| 2005/0109029 | A1 | 5/2005 | Busch | |
| 2010/0192929 | A1 * | 8/2010 | Ishiwatari | G01M 15/104 123/674 |
| 2012/0060474 | A1 * | 3/2012 | Turpin | F01N 13/14 60/299 |
| 2012/0285263 | A1 * | 11/2012 | Kado | F01N 3/22 73/861.351 |
| 2014/0020367 | A1 * | 1/2014 | Kim | F01N 11/007 60/277 |
| 2017/0314442 | A1 * | 11/2017 | Lipa | F01N 3/22 |

FOREIGN PATENT DOCUMENTS

| | | | |
|---|---|---|---|
| JP | 3821391 | B2 | 9/2006 |
| JP | 2007321662 | A | 12/2007 |

* cited by examiner

*Primary Examiner* — Anthony Ayala Delgado
(74) *Attorney, Agent, or Firm* — Vincent Mastrogiacomo; McCoy Russell LLP

(57) ABSTRACT

A method for monitoring a secondary airflow (SAIR) system in an engine includes determining degradation of the SAIR system adding a SAIR to downstream of an engine cylinder exhaust based on a comparison of the SAIR before and after a shutdown of a SAIR pump, the SAIR calculated from a fuel injection amount, an exhaust air-fuel ratio, and an engine intake airflow. In this way, SAIR at the exhaust manifold can be monitored utilizing existing onboard sensors and technology, thereby maintaining OBD and emissions monitoring, reducing engine emissions, and maintaining costs.

20 Claims, 7 Drawing Sheets

SYSTEMS AND METHODS FOR OPERATING AN ENGINE INCLUDING A SECONDARY AIR SYSTEM

FIELD

The present description relates generally to methods and systems for operating a secondary air system in an engine.

BACKGROUND/SUMMARY

Injection of secondary airflow (SAIR) is a vehicle emissions reduction strategy whereby air is delivered into the exhaust stream of a vehicle engine to increase combustion of hydrocarbon fuel in the engine exhaust. When SAIR is reduced, for example, due to problems with the SAIR system, combustion of exhaust hydrocarbons can decrease, resulting in increased vehicle emissions. Conventional OBD engine systems monitor SAIR by measuring SAIR directly within the SAIR system. For example, SAIR may be measured by a mass air flow (MAF) sensor and/or a pressure sensor positioned within the SAIR system.

However, the inventors herein have recognized potential issues with such systems. In particular, these conventional engine systems do not include confirmation of the SAIR being delivered to the engine exhaust stream where the SAIR fluidly contacts and reacts with the uncombusted hydrocarbon fuel. Furthermore, in cases where the engine cylinders are arranged in cylinder banks, SAIR delivery issues and resulting emissions increases cannot be determined by conventional engine systems on a per cylinder bank basis. As an example, in cases where problems with delivery of SAIR occur downstream of the SAIR MAF or SAIR pressure sensor, a decrease in SAIR to the engine exhaust stream may not be detected, leading to increased engine emissions.

In one example, the issues described above may be addressed by a method for monitoring a secondary airflow (SAIR) system in an engine, including determining degradation of the SAIR system adding a SAIR to downstream of an engine cylinder exhaust based on a comparison of the SAIR before and after a shutdown of a SAIR pump, the SAIR calculated from a fuel injection amount, an exhaust air-fuel ratio, and an engine intake airflow. In this way, SAIR at the exhaust manifold can be monitored utilizing existing onboard sensors and technology, thereby maintaining OBD and emissions monitoring, reducing engine emissions, and maintaining costs.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
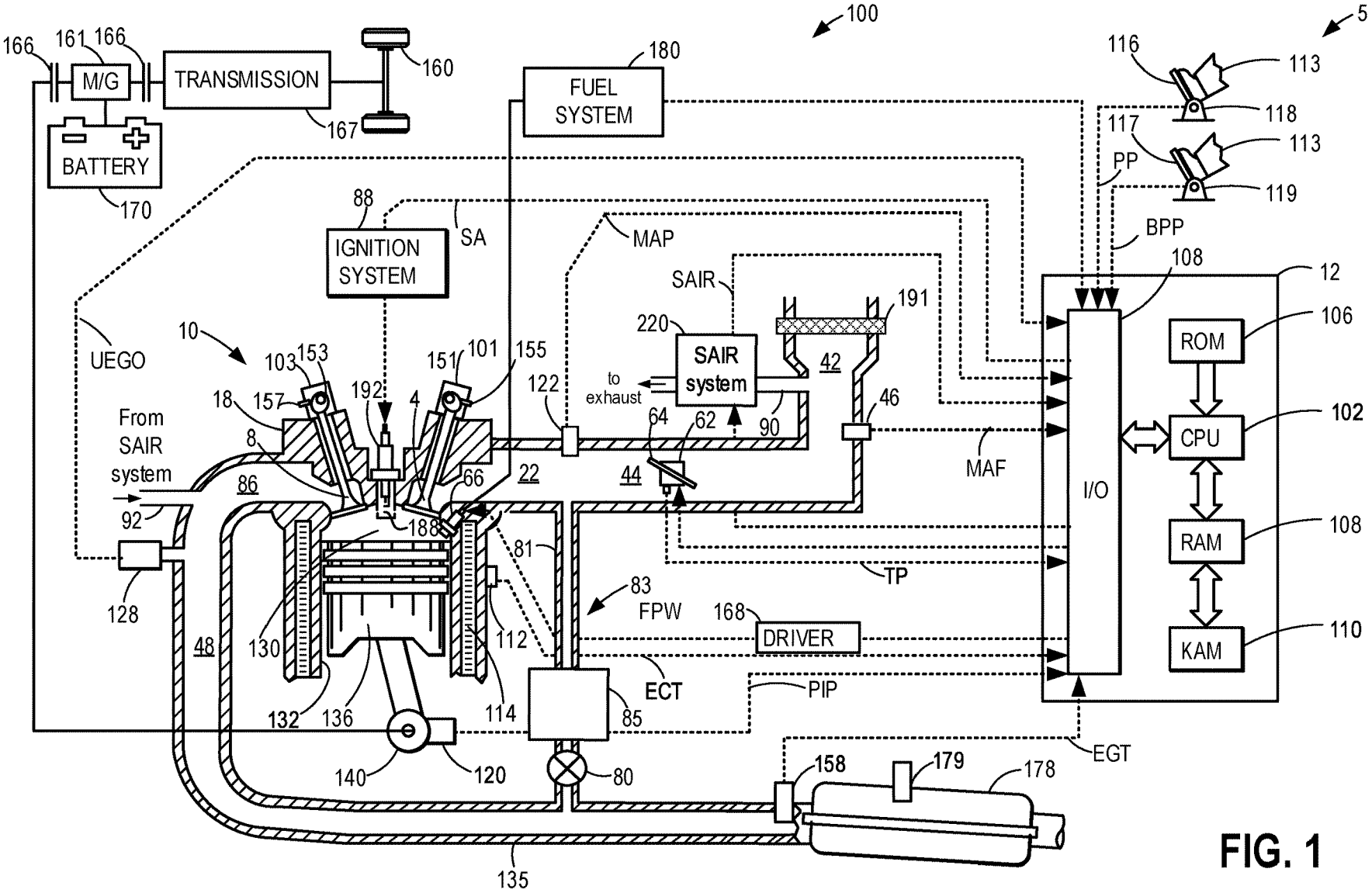
FIG. 1 shows a schematic depiction of an engine system of a vehicle, including a secondary air (SAIR) system.
Figure 2:
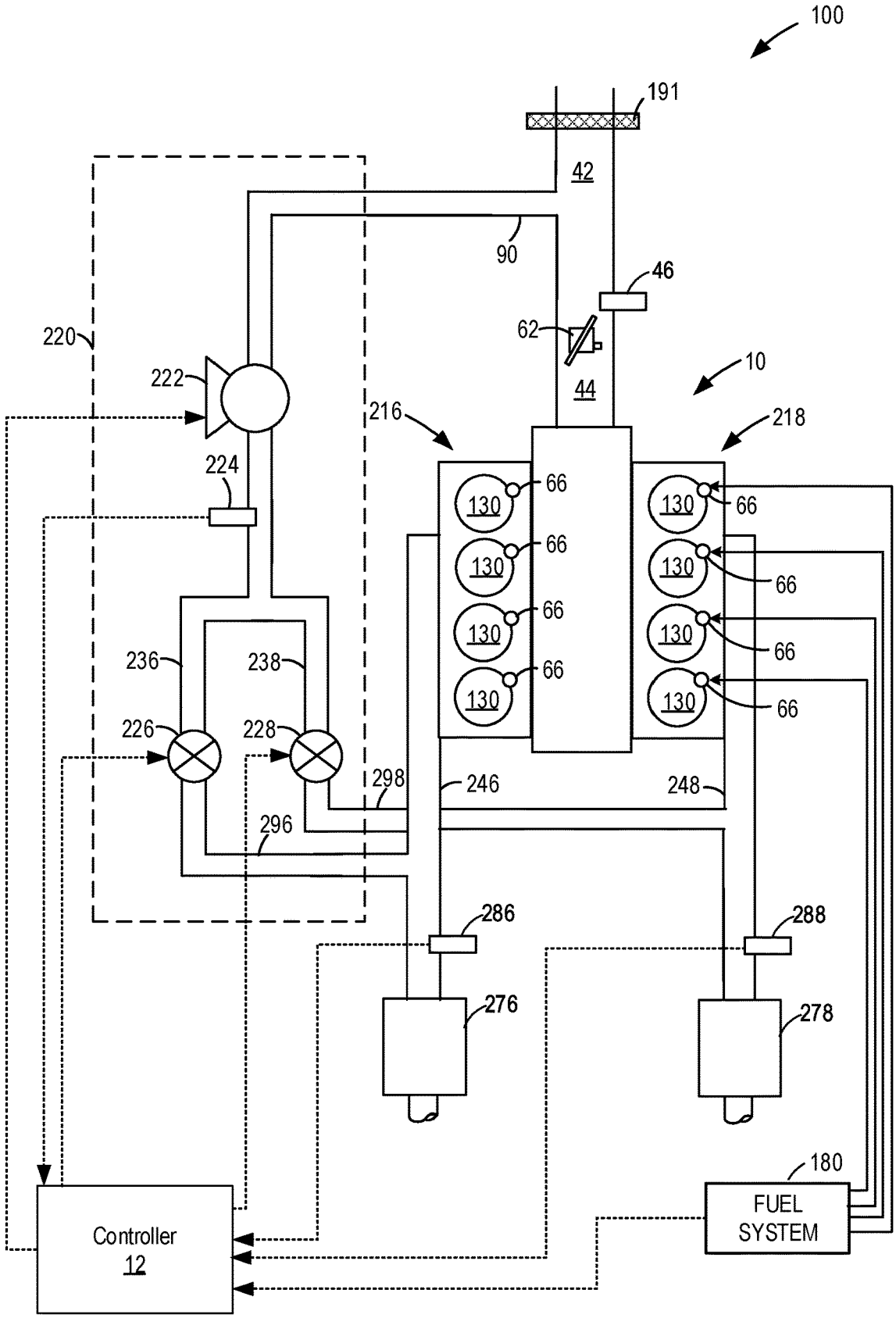
FIG. 2 shows a partial schematic depiction of the engine system of FIG. 1, including the engine and the SAIR system of FIG. 1.
Figure 3:
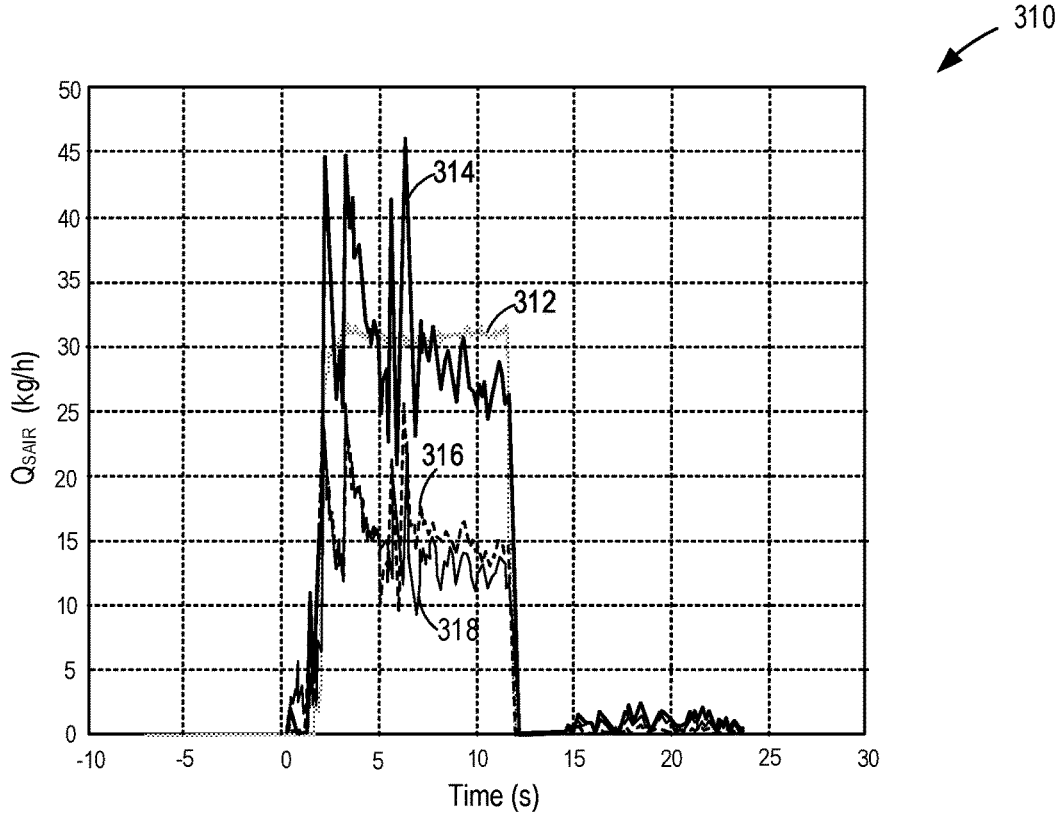
FIG. 3 shows data plots comparing example SAIR flow data corresponding to the engine system of FIGS. 1 and 2.
Figure 3:
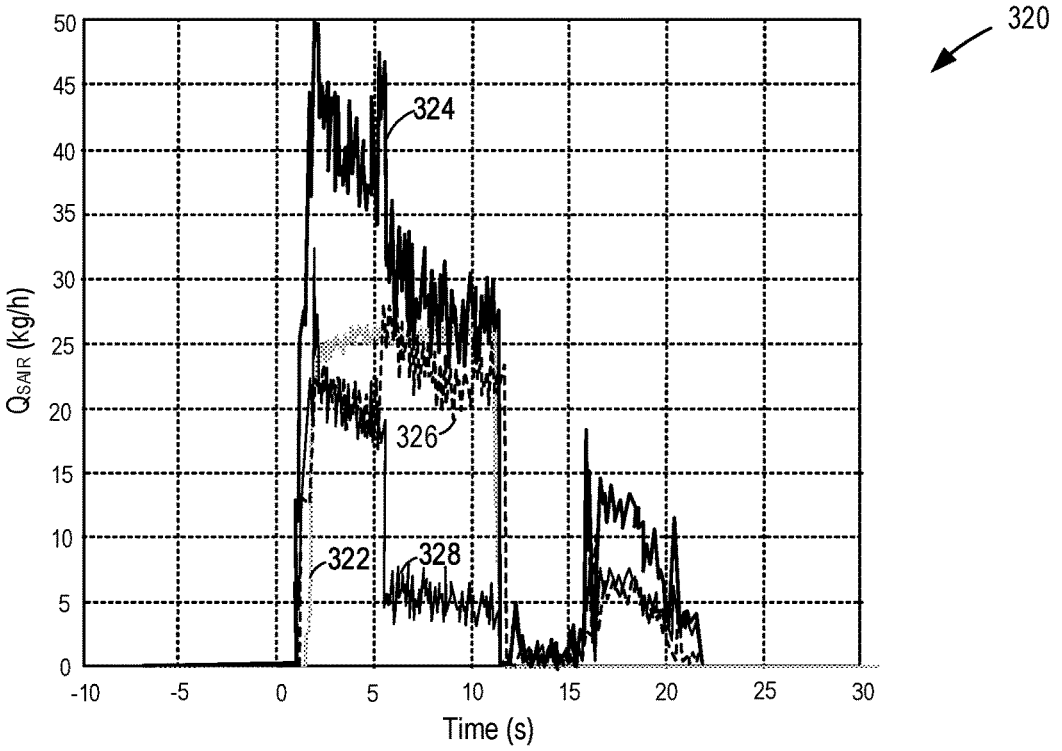
Figure 4:
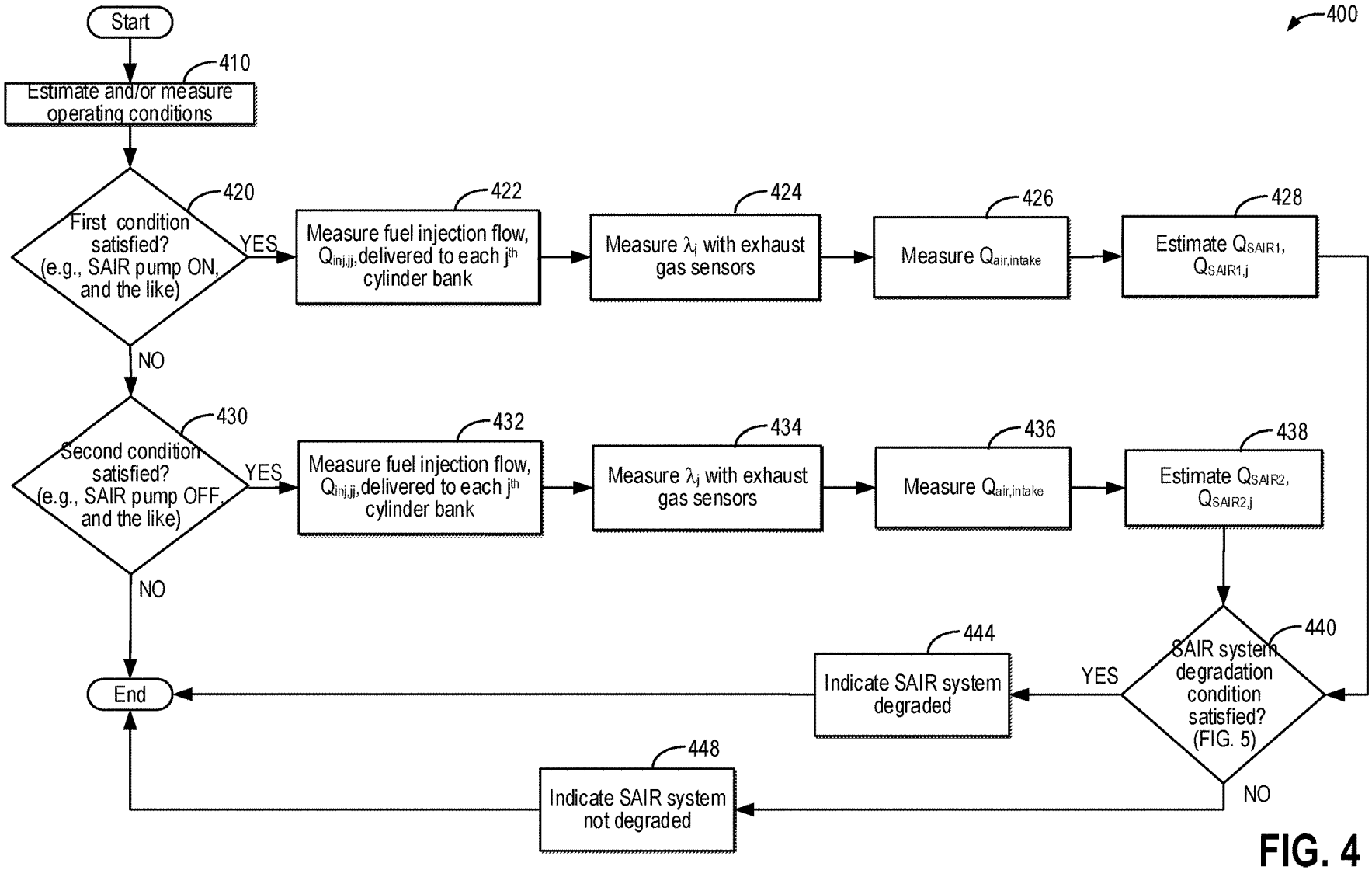
FIGS. 4 and 5 show example flow charts illustrating a method for operating the engine system including the SAIR system of FIGS. 1 and 2.
Figure 5:
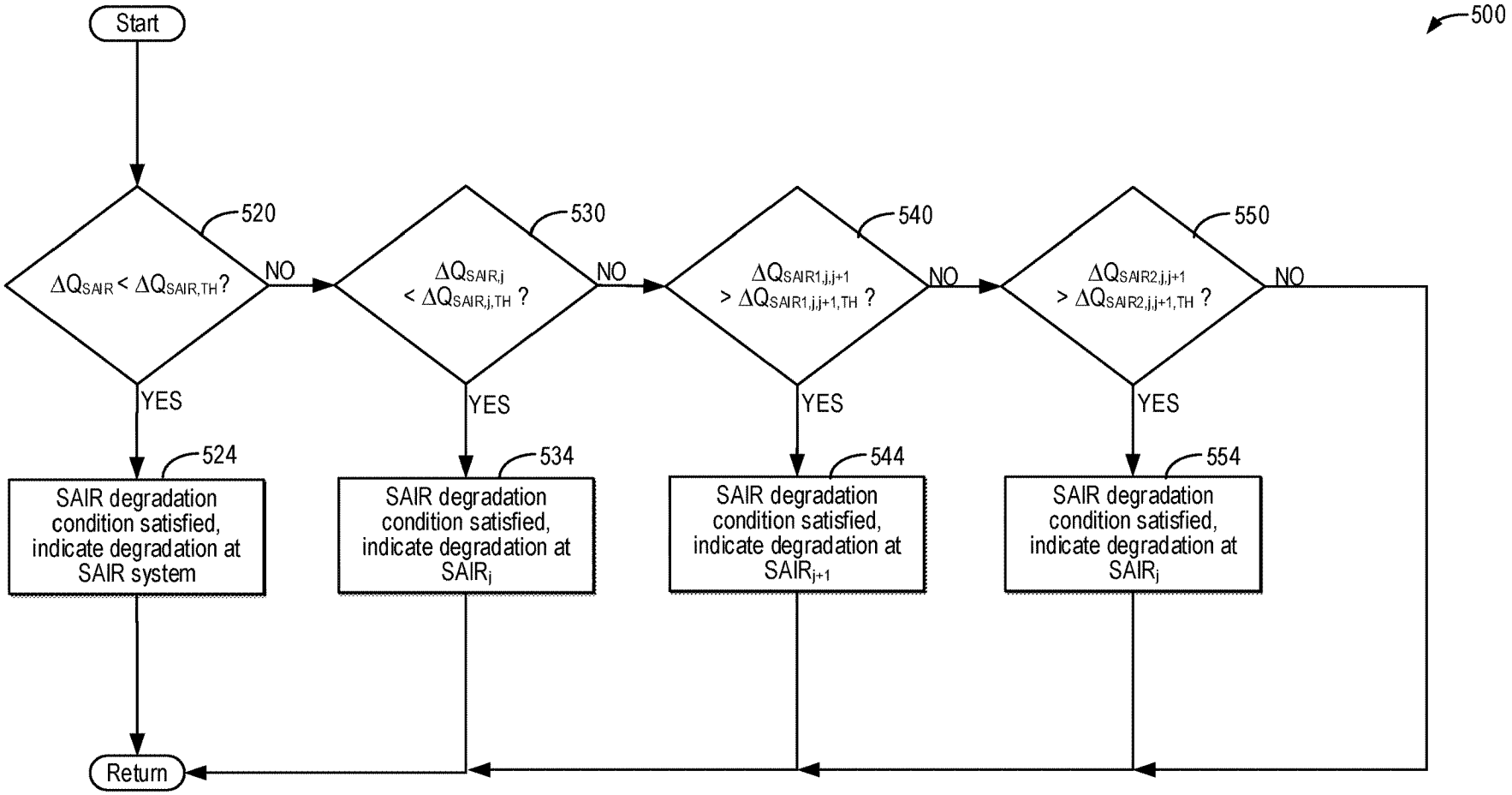
Figure 6:
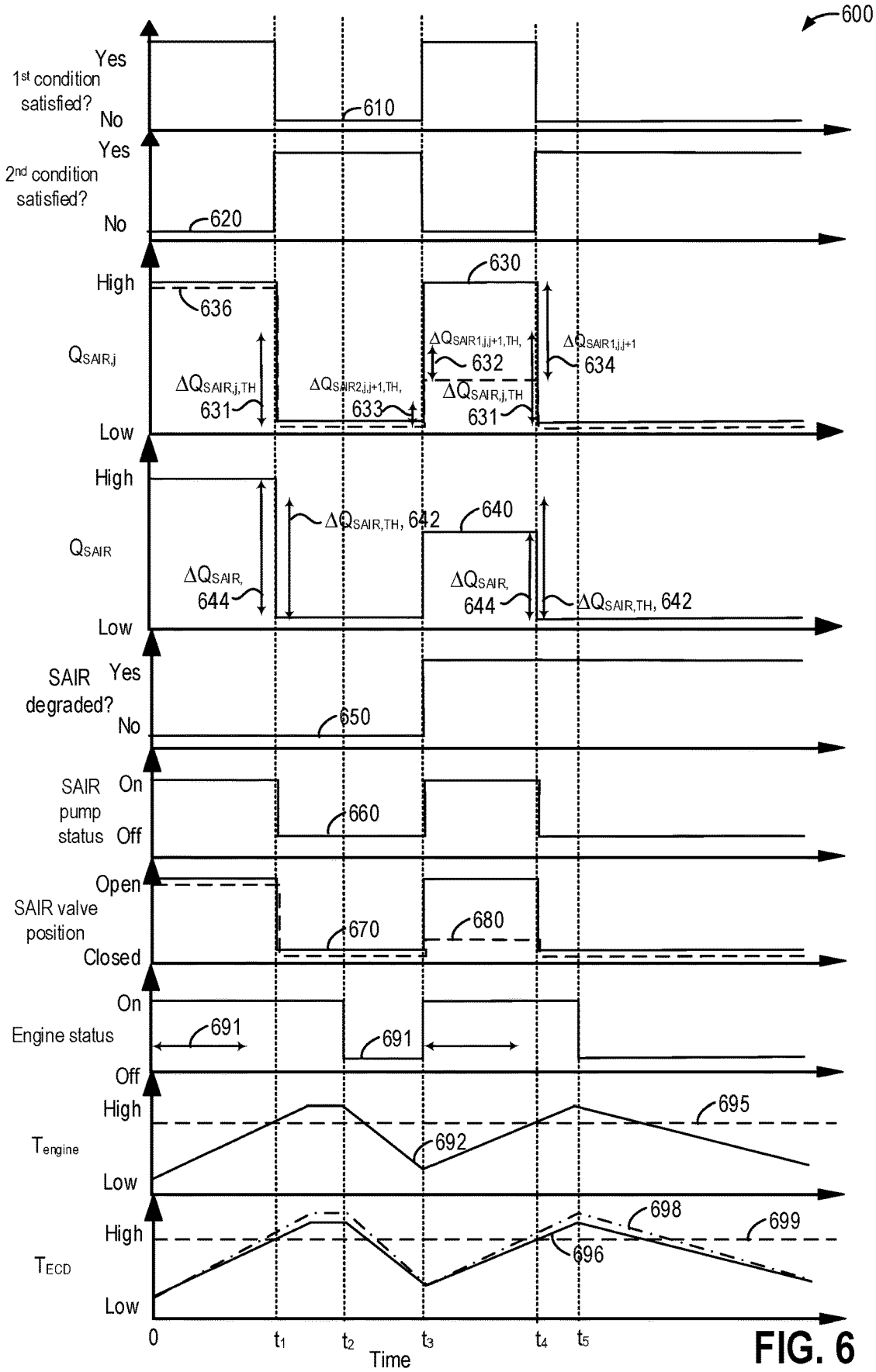
FIG. 6 shows an example timeline corresponding to operating the engine system including the SAIR system of FIGS. 1 and 2.
Figure 7:
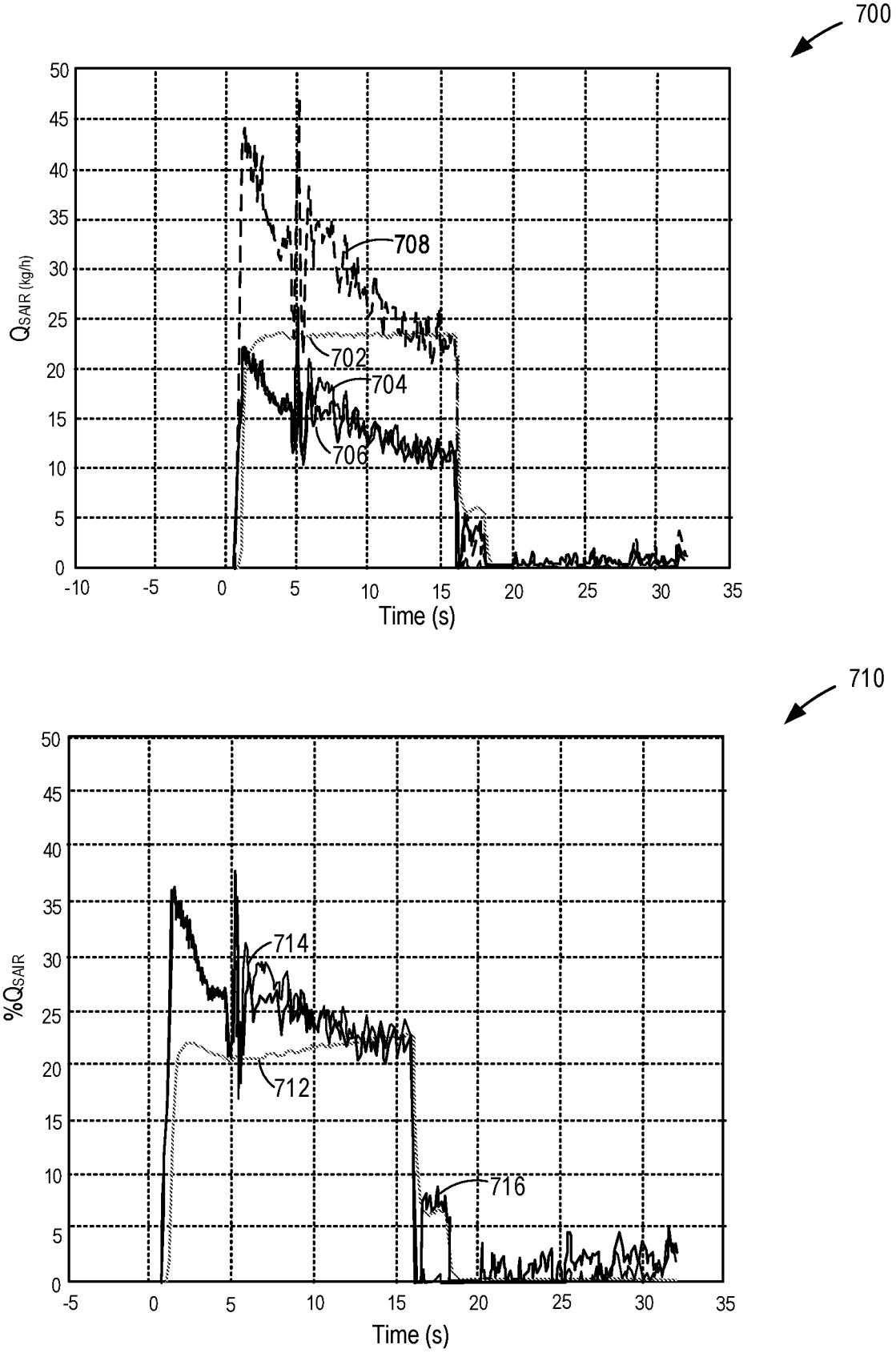
FIG. 7 shows data plots comparing example SAIR flow data corresponding to the engine system of FIGS. 1 and 2.

The following description relates to systems and methods operating an engine system including a secondary airflow (SAIR) system. In one example, the SAIR system is fluidly coupled between an air intake and an exhaust manifold of an engine of a vehicle, as illustrated in FIGS. 1 and 2. An amount of the SAIR at the exhaust manifold can be estimated from measurements of the intake air and fuel flow delivered to the engine, and the air-to-fuel ratio (AFR) at the engine exhaust before and after shutdown of the SAIR system, as illustrated by the methods of FIGS. 4 and 5. FIGS. 3 and 7 show plots comparing measured SAIR upstream of the exhaust with calculated SAIR at the engine exhaust. A timeline for operating the engine system of FIGS. 1 and 2 according to the methods of FIGS. 4 and 5 is illustrated in FIG. 6.

Turning now to the figures, FIG. 1 shows an engine system 100 that may be included in a vehicle 5, the engine system 100 including a partial view of a single cylinder 130 of an internal combustion engine 10. Internal combustion engine 10 may be a multi-cylinder engine. Cylinder (e.g., combustion chamber) 130 includes a coolant sleeve 114 and cylinder walls 132, with a piston 136 positioned therein and connected to a crankshaft 140. Cylinder 130 is shown communicating with an intake manifold 44 via an intake valve 4 and an intake port 22 and with an exhaust manifold 48 via an exhaust valve 8 and an exhaust port 86. Intake passage 42 may include an air filter 191 for filtering intake air passing through the intake passage. A throttle 62 including a throttle plate 64 may be provided in an intake passage downstream from air filter 191 and upstream of intake manifold 44 for varying a flow rate and/or pressure of intake air provided to the engine cylinders 130. A MAF sensor 120 may be coupled to the intake passage 42 between air filter 191 and throttle 62 for providing a MAF signal to controller 12. A MAP sensor 122 may be coupled to intake manifold 44 downstream of throttle 62 for providing respective MAP signal to controller 12.

As further described herein with reference to FIGS. 2-6, the engine may be configured to inject secondary airflow (SAIR) into the exhaust manifold 48 to increase conversion of certain emissions during various engine operating conditions. As depicted in FIG. 1, the SAIR system 220 may be fluidly coupled to the intake passage 42 downstream of the air filter 191 and upstream from the throttle 62 by way of SAIR intake passage 90. SAIR system 220 may deliver SAIR to the exhaust manifold 48 by way of SAIR exhaust passage 92. SAIR exhaust passage 92 is fluidly coupled to the exhaust manifold 48 downstream from exhaust port 86 and upstream of exhaust gas sensor 128 and emission control device 178. The SAIR system 220 may additionally or alternatively include other configurations for delivering SAIR to the exhaust manifold 48. In one example, the SAIR system 220 may be fluidly coupled to the intake manifold 44 downstream of throttle 62 by way of SAIR intake passage 90, whereby SAIR system 220 may deliver compressed air to the exhaust manifold 48. In another example, the SAIR system 220 may include an external air pump that delivers air directly from the atmosphere to the exhaust manifold 48. In another example, the SAIR system 220 may include means for delivering air to the exhaust manifold 48 by way of EGR passage 81 when the EGR valve 80 closed.

In the depicted view, intake valve 4 and exhaust valve 8 are located at an upper region of cylinder 130, and may be coupled to a cylinder head 18. Intake valve 4 and exhaust valve 8 may be controlled by a controller 12 using respective cam actuation systems including one or more cams. The cam actuation systems may utilize one or more of variable displacement engine (VDE), cam profile switching (CPS), variable cam timing (VCT), variable valve timing (VVT), and/or variable valve lift (VVL) systems to vary valve operation. In the depicted example, intake valve 4 is controlled by an intake cam 151, and exhaust valve 8 is controlled by an exhaust cam 153. The intake cam 151 may be actuated via an intake valve timing actuator 101 and the exhaust cam 153 may be actuated via an exhaust valve timing actuator 103 according to set intake and exhaust valve timings, respectively. In some examples, the intake valve and exhaust valve may be deactivated via the intake valve timing actuator 101 and exhaust valve timing actuator 103, respectively. The position of intake cam 151 and exhaust cam 153 may be determined by camshaft position sensors 155 and 157, respectively.

In some examples, the intake and/or exhaust valve may be controlled by electric valve actuation. For example, cylinder 130 may alternatively include an intake valve controlled via electric valve actuation and an exhaust valve controlled via cam actuation, including CPS and/or VCT systems. In still other examples, the intake and exhaust valves may be controlled by a common valve actuator or actuation system or a variable valve timing actuator or actuation system. The various valve control systems may be used to vary a timing, open duration, and lift of intake valve 4 and exhaust valve 8.

An exhaust passage 135 can receive exhaust gases from other cylinders of engine 10 in addition to cylinder 130. An exhaust gas sensor 128 is shown coupled to exhaust passage 135 upstream of an emission control device 178. Exhaust gas sensor 128 may be selected from among various suitable sensors for providing an indication of an exhaust gas air-fuel ratio (AFR), such as a linear oxygen sensor or UEGO (universal or wide-range exhaust gas oxygen), a two-state oxygen sensor or EGO, a HEGO (heated EGO), a NOx sensor, a HC sensor, or a CO sensor, for example. Emission control device 178 may be a three-way catalyst, a NOx trap, various other emission control devices, or combinations thereof.

External exhaust gas recirculation (EGR) may be provided to the engine via a high pressure EGR system 83, delivering exhaust gas from a zone of higher pressure in exhaust passage 135 to a zone of lower pressure in intake manifold 44, downstream of throttle 62, via an EGR passage 81. An amount of EGR provided to intake manifold 44 may be varied by controller 12 via an EGR valve 80. For example, controller 12 may be configured to actuate and adjust a position of EGR valve 80 to adjust the amount of exhaust gas flowing through EGR passage 81. EGR valve 80 may be adjusted between a fully closed position, in which exhaust gas flow through EGR passage 81 is blocked, and a fully open position, in which exhaust gas flow through the EGR passage is enabled. As an example, EGR valve 80 may be continuously variable between the fully closed position and the fully open position. As such, the controller may increase a degree of opening of EGR valve 80 to increase an amount of EGR provided to intake manifold 44 and decrease the degree of opening of EGR valve 80 to decrease the amount of EGR provided to intake manifold 44. As an example, EGR valve 80 may be an electronically actuated solenoid valve. In other examples, EGR valve 80 may be positioned by an incorporated stepper motor, which may be actuated by controller 12 to adjust the position of EGR valve 80 through a range of discreet steps (e.g., 52 steps), or EGR valve 80 may be another type of flow control valve. Further, EGR may be cooled via passing through an EGR cooler 85 within EGR passage 81. EGR cooler 85 may reject heat from the EGR gases to engine coolant, for example.

Under some conditions, the EGR system may be used to regulate a temperature of the air and fuel mixture within the combustion chamber. Further, EGR may be desired to attain a desired engine dilution, thereby increasing fuel efficiency and emissions quality, such as emissions of nitrogen oxides. As an example, EGR may be requested at low-to-mid engine loads. Thus, it may be desirable to measure or estimate the EGR mass flow. EGR sensors may be arranged within EGR passage 81 and may provide an indication of one or more of mass flow, pressure, and temperature of the exhaust gas, for example. Additionally, EGR may be desired after emission control device 178 has attained its light-off temperature. An amount of EGR requested may be based on engine operating conditions, including engine load, engine speed, engine temperature, etc. For example, controller 12 may refer to a look-up table having the engine speed and load as the input and output a desired amount of EGR corresponding to the input engine speed-load. In another example, controller 12 may determine the desired amount of EGR (e.g., desired EGR flow rate) through logic rules that directly take into account parameters such as engine load, engine speed, engine temperature, etc. In still other examples, controller 12 may rely on a model that correlates a change in engine load with a change in a dilution requirement, and further correlates the change in the dilution requirement with a change in the amount of EGR requested. For example, as the engine load increases from a low load to a mid-load, the amount of EGR requested may increase, and then as the engine load increases from a mid-load to a high load, the amount of EGR requested may decrease. Controller 12 may further determine the amount of EGR requested by taking into account a best fuel economy mapping for a desired dilution rate. After determining the amount of EGR requested, controller 12 may refer to a look-up table having the requested amount of EGR as the input and a signal corresponding to a degree of opening to apply to the EGR valve (e.g., as sent to the stepper motor or other valve actuation device) as the output.

Cylinder 130 can have a compression ratio, which is a ratio of volumes when piston 136 is at bottom dead center to top dead center. Conventionally, the compression ratio is in a range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock. The compression ratio may also be increased if pre-chamber ignition increases knock resistance due to faster combustion.

As a non-limiting example, cylinder 130 is shown including a fuel injector 66. Fuel injector 66 is shown coupled directly to cylinder 130 for injecting fuel directly therein in proportion to a pulse-width of a signal FPW received from controller 12 via an electronic driver 168. In this manner, fuel injector 66 provides what is known as direct injection (hereafter also referred to as "DI") of fuel into cylinder 130. In another example, fuel injector 66 may be a port injector providing fuel into the intake port upstream of cylinder 130. Further, while FIG. 1 shows fuel injected to the cylinder via a single injector, the engine may alternatively be operated by injecting fuel via multiple injectors, such as one direct injector and one port injector. For example, both port and direct injectors may be included in a configuration that is known as port fuel and direct injection (PFDI). In such a configuration, controller 12 may vary a relative amount of injection from each injector. In this way, controller 12 may control and determine, based on engine and vehicle operating conditions, a fuel injection flow rate, to each $j^{th}$ engine cylinder 130.

Fuel may be delivered to fuel injector 66 from a high pressure fuel system 180 including one or more fuel tanks, fuel pumps, and a fuel rail. Alternatively, fuel may be delivered by a single stage fuel pump at a lower pressure. Further, while not shown, the fuel tanks may include a pressure transducer providing a signal to controller 12. Fuel tanks in fuel system 180 may hold fuel with different fuel qualities, such as different fuel compositions. These differences may include different alcohol content, different octane, different heats of vaporization, different fuel blends, and/or combinations thereof, etc. One example of fuels with different heats of vaporization includes gasoline as a first fuel type with a lower heat of vaporization and ethanol as a second fuel type with a greater heat of vaporization. In another example, the engine may use gasoline as a first fuel type and an alcohol-containing fuel blend, such as E85 (which is approximately 85% ethanol and 15% gasoline) or M85 (which is approximately 85% methanol and 15% gasoline), as a second fuel type. Other feasible substances include water, methanol, a mixture of ethanol and water, a mixture of water and methanol, a mixture of alcohols, etc. In this way, air and fuel are delivered to cylinder 130, which may produce a combustible air-fuel mixture.

Fuel may be delivered by fuel injector 66 to cylinder 130 during a single cycle of the cylinder. Further, the distribution and/or relative amount of fuel delivered from fuel injector 66 may vary with operating conditions. Furthermore, for a single combustion event, multiple injections of the delivered fuel may be performed per cycle. The multiple injections may be performed during a compression stroke, intake stroke, or any appropriate combination thereof.

In the example shown in FIG. 1, cylinder 130 includes a pre-chamber igniter 192 coupled to cylinder head 18 for initiating combustion. In some examples, the pre-chamber igniter 192 may be coupled to a mounting surface different than the cylinder head 18, such as a cylinder block or other portion of the cylinder. In one example, the pre-chamber igniter 192 is the only ignition device of the cylinder 130. As such, there are no other ignition devices in the engine 10 other than the pre-chamber igniter 192 corresponding to each cylinder 130.

An ignition system 88 may produce an ignition spark in pre-chamber igniter 192 in response to a spark advance signal SA from controller 12 under select operating modes. A timing of signal SA may be adjusted based on engine operating conditions and a driver torque demand. For example, spark may be provided at maximum brake torque (MBT) timing to maximize engine power and efficiency. Controller 12 may input engine operating conditions, including engine speed, engine load, and exhaust gas AFR, into a look-up table, which may output the corresponding MBT timing for the input engine operating conditions. In other examples, spark may be retarded from MBT to prevent an occurrence of knock. In still other examples, spark may be retarded from MBT to reduce engine torque, such as due to a decrease in driver-demanded torque or a transmission gear shift event, or to provide a torque reserve.

Engine 10 may be controlled at least partially by controller 12 and by input from a vehicle operator 113 via an accelerator pedal 116 and an accelerator pedal position sensor 118 and via a brake pedal 117 and a brake pedal position sensor 119. The accelerator pedal position sensor 118 may send a pedal position signal (PP) to controller 12 corresponding to a position of accelerator pedal 116, and the brake pedal position sensor 119 may send a brake pedal position (BPP) signal to controller 12 corresponding to a position of brake pedal 117. Controller 12 is shown in FIG. 1 as a microcomputer, including a microprocessor unit 102, input/output ports 104, an electronic storage medium for executable programs and calibration values shown as a read-only memory 106 in this particular example, random access memory 108, keep alive memory 110, and a data bus. Storage medium read-only memory 106 can be programmed with computer readable data representing instructions executable by microprocessor unit 102 for performing the methods and routines described herein as well as other variants that are anticipated but not specifically listed.

Controller 12 may receive various signals from sensors coupled to engine 10, in addition to those signals previously discussed, including a measurement of inducted mass air flow (MAF) from a mass air flow sensor 46, an engine coolant temperature signal (ECT) from an ECT sensor 112 coupled to coolant sleeve 114, signal UEGO from exhaust gas sensor 128, which may be used by controller 12 to determine the AFR of the exhaust gas, an exhaust gas temperature signal (EGT) from a temperature sensor 158 coupled to exhaust passage 135, an ECD temperature sensor 179 coupled to the ECD 178, a profile ignition pickup signal (PIP) from a Hall effect sensor 120 (or other type) coupled to crankshaft 140, a throttle position (TP) from a throttle position sensor coupled to throttle 62, and an manifold absolute pressure signal (MAP) from a MAP sensor 122 coupled to intake manifold 44. An engine speed signal, RPM, may be generated by controller 12 from signal PIP. The manifold pressure signal MAP from the manifold pressure sensor may be used to provide an indication of vacuum or pressure in the intake manifold 44. Furthermore, controller 12 may send and receive a SAIR signal to and from SAIR system 220 for operating the SAIR system 220 responsive to operating conditions, as further described with reference to FIGS. 2-6. In one example, the SAIR signal may indicate when a SAIR pump is switched ON or OFF. In another example, the controller 12 may transmit a SAIR signal to toggle the SAIR pump 222 ON/OFF status and/or adjust a position of one or more SAIR flow control valves 226 and 228. In another non-limiting example, controller 12 may receive a SAIR signal from SAIR flow sensor 224, indicating a flow rate of SAIR.

Based on input from one or more of the above-mentioned sensors, controller 12 may adjust one or more actuators, such as fuel injector 66, throttle 62, pre-chamber igniter 192, the intake/exhaust valves and cams, etc. The controller 12 may receive input data from the various sensors, process the input data, and trigger the actuators in response to the processed input data based on instructions or code programmed therein corresponding to one or more routines, an example of which is described with respect to FIGS. 4 and 5.

In some examples, vehicle 5 may be a hybrid vehicle with multiple sources of torque available to one or more vehicle wheels 160. In other examples, vehicle 5 is a conventional vehicle with only an engine. In the example shown in FIG. 1, the vehicle includes engine 10 and an electric machine 161. Electric machine 161 may be a motor or a motor/generator and thus may also be referred to herein as an electric motor. Electric machine 161 receives electrical power from a traction battery 170 to provide torque to vehicle wheels 160. Electric machine 161 may also be operated as a generator to provide electrical power to charge battery 170, for example, during a braking operation.

Crankshaft 140 of engine 10 and electric machine 161 are connected via a transmission 167 to vehicle wheels 160 when one or more clutches 166 are engaged. In the depicted example, a first clutch 166 is provided between crankshaft 140 and electric machine 161, and a second clutch 166 is provided between electric machine 161 and transmission 167. Controller 12 may send a signal to an actuator of each clutch 166 to engage or disengage the clutch, so as to connect or disconnect crankshaft 140 from electric machine 161 and the components connected thereto, and/or connect or disconnect electric machine 161 from transmission 167 and the components connected thereto. Transmission 167 may be a gearbox, a planetary gear system, or another type of transmission. The powertrain may be configured in various manners including as a parallel, a series, or a series-parallel hybrid vehicle.

As described above, FIG. 1 shows only one cylinder of a multi-cylinder engine. As such, each cylinder may similarly include its own set of intake/exhaust valves, fuel injector(s), igniter, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 130. Further still, the multiple cylinders may be arranged and/or organized into one or more banks of cylinders, whereby each bank of cylinders is arranged in a separate line parallel to the crankshaft. Arranging engine cylinders in banks can aid in reducing a size of the engine, and in reducing engine vibration.

Turning now to FIG. 2, it illustrates another schematic of the engine system 100 including engine 10, SAIR system 220 and controller 12. Components of the engine system 100 previously introduced in FIG. 1 are numbered identically in this figure and subsequent figures. Several elements of engine 10, such as EGR system 83, ignition system 88, transmission 167, and the like (as shown in FIG. 1), are omitted in FIG. 2 for clarity; however, engine system 100 may include all of the elements of engine 10, as shown in FIG. 1. Furthermore, engine system 100 may be included as part of a vehicle system, such as vehicle 5, of FIG. 1.

Engine system 100 may include multiple cylinders 130 arranged into one or more cylinder banks. In particular, the two cylinder banks 216 and 218 of four cylinders 130 are shown in the example of engine system 100. In other examples, engine system 100 may include more than two cylinder banks, each bank having more or less than four cylinders 130. As described previously with reference to FIG. 1, intake air entering intake passage 42 is filtered through air filter 191 before passing through throttle 62 to intake manifold 44 of engine 10. MAF sensor 46 may be fluidly coupled at intake passage 42 between SAIR intake passage 90 and throttle 62 to measure a flow rate of air entering the intake manifold, $Q_{air,intake}$. In other words, $Q_{air,intake}$ does not include the SAIR, $Q_{SAIR}$, directed to SAIR intake passage 90.

Fuel system 180 may deliver fuel to fuel injectors 66 (e.g., direct fuel and/or port fuel injectors) included at each cylinder 130. FIG. 2 shows fuel injection lines coupling fuel system 180 and cylinders 130 of cylinder bank 218. Although not depicted for clarity, engine system 100 further includes fuel injection lines coupling fuel system 180 to cylinders 13 of cylinder bank 216. As described with reference to FIG. 1, the controller 12 may control and determine, based on engine and vehicle operating conditions, a fuel injection flow rate, $Q_{inj,j}$, to each $j^{th}$ engine cylinder 130 of each $i^{th}$ cylinder bank (e.g., for the case of 2 cylinder banks, each with 4 cylinders, i=2 and j=4). In particular, fuel may be injected in proportion to a pulse-width of a signal FPW received from controller 12 by way of an electronic driver 168, and the fuel injection rate at each cylinder may be varied depending on engine operating conditions.

Intake air is delivered to each cylinder 130 of each cylinder bank 216 and 218 of engine 10 by way of intake manifold 44. In one example, intake manifold 44 may divide and deliver the intake air evenly to each cylinder bank 216 and 218, and/or to each cylinder 130. Cylinder combustion products, including unreacted air, uncombusted fuel hydrocarbons, and the like are exhausted from the cylinders 130 by way of exhaust manifolds 246 and 248. As depicted in FIG. 2, each exhaust manifold 246 and 248 corresponds to one of the cylinder banks 216 and 218, respectively. Furthermore, an exhaust gas sensor 286 and 288 is coupled upstream of an emission control device 276 and 278, corresponding to each exhaust manifold 246 and 278, respectively. The exhaust gas sensors 286 and 288 may correspond to exhaust gas sensor 128, and may include one or more various suitable sensors for providing an indication of an exhaust gas air-fuel ratio (AFR), such as a linear oxygen sensor or UEGO (universal or wide-range exhaust gas oxygen), a two-state oxygen sensor or EGO, a HEGO (heated EGO), a NOx sensor, a HC sensor, or a CO sensor, for example. Emission control devices 276 and 278 may correspond to emission control device 178, and may include a three-way catalyst, a NOx trap, various other emission control devices, or combinations thereof.

A portion of the intake air may be diverted from intake passage 42 to SAIR system 220 by way of SAIR intake passage 90. SAIR system 220 can include SAIR pump 222, SAIR flow sensor 224, and one or more SAIR flow control valves 226 and 228 positioned in SAIR exhaust passages 296 and 298, respectively. The SAIR exhaust passages 296 and 298 of FIG. 2 may be fluidly coupled to exhaust manifolds 246 and 248, respectively, and may correspond to SAIR exhaust passage 92. Furthermore, SAIR system 220 can include one or more flow control valves 226 and 228 and one or more SAIR exhaust passages 296 and 298, each of the SAIR exhaust passages 296 and 298 fluidly coupled to one of the exhaust manifolds 246 and 248. Each of the exhaust manifolds 246 and 248 correspond to the one of the cylinder banks 216 and 218. SAIR flow control valves 226 and 228 may further act as check valves, preventing exhaust gases from flowing upstream from the SAIR exhaust passages 296 and 298 and past SAIR flow control valves 226 and 228.

Accordingly SAIR may be diverted from the intake passage 42 and delivered to the one or more exhaust manifolds 246 and 248 during a condition when SAIR pump 222 is turned on and when one or more of the SAIR flow control valves 226 and 228 are open. Furthermore, SAIR flow rate, $Q_{SAIR,meas}$ may be measured and/or inferred by SAIR flow sensor 224 and communicated to controller 12. SAIR flow sensor 224 may include a SAIR MAF sensor that directly measures the SAIR mass flow rate. In another example, SAIR flow sensor may include an orifice and one or more pressure sensors for indicating SAIR flow based on a pressure drop measured across the orifice. SAIR pump 222 and SAIR flow control valves 226 and 228 are conductively coupled to the controller 12, whereby the controller 12 may turn SAIR pump 222 on or off, and/or adjust a position of one or both of SAIR flow control valves 226 and 228, responsive to various engine operating conditions. Adjusting a position of one or both of SAIR flow control valves 226 and 228 includes moving one or both of SAIR flow control valves 226 and 228 to a more open position and/or to a more closed position. In one example, adjusting one or both of SAIR flow control valves 226 and 228 to a more open position includes fully opening one or both of SAIR flow control valves 226 and 228; similarly, adjusting one or both of SAIR flow control valves 226 and 228 to a more closed position includes fully closing one or both of SAIR flow control valves 226 and 228. As such, controller 12 can direct and distribute SAIR evenly or unevenly to each of the exhaust manifolds 246 and 248 by adjusting positions of the SAIR flow control valves 226 and 228.

In one example, controller 12 may startup SAIR system 220 to deliver SAIR to the engine exhaust manifolds 246 and 248 following a cold start engine event during a cold start condition, the cold start condition including when a temperature of one or more of the ECDs 276 and 278, $T_{ECD,j}$ (j index refers to corresponding to the $j^{th}$ cylinder bank), is less than a threshold ECD temperature, $T_{ECD,TH}$. As an example, $T_{ECD,TH}$ may include temperatures less than 200 degrees Fahrenheit. In another example, the cold start condition may further include when an engine temperature, $T_{engine}$, is less than a threshold engine temperature, $T_{engine,TH}$, and when an engine status has been switched from OFF to ON. In one example, $T_{engine,TH}$ may include temperatures less than 40 degrees Fahrenheit. In a further example the cold start condition may further include prior to when a threshold post-engine start duration, $\Delta t_{START,TH}$, following an engine start (e.g., engine status switching from OFF to ON) has elapsed.

When the cold start condition is satisfied, fuel combustion at the engine cylinders 130 may be less efficient, resulting in higher amounts of uncombusted fuel exhausted from the engine at the exhaust manifolds 246 and 248, which can give rise to higher emissions. Furthermore, when an ECD temperature is less than the threshold ECD temperature, the ability of the ECD to remove pollutants, including uncombusted fuel hydrocarbons, may be reduced. Furthermore, when a duration following an engine start event, $\Delta t_{START}$, is less than the threshold post-engine start duration, $\Delta t_{START,TH}$, emissions of uncombusted fuel can be higher. As such, when one or more of the engine status is ON and $T_{engine}<T_{engine,TH}$, $T_{ECD,j}<T_{ECD,TH}$, and $\Delta t_{START}<\Delta t_{START,TH}$, the cold start condition may be satisfied, and controller 12 may startup SAIR system 220 by switching SAIR pump 222 ON and opening one or more of SAIR flow control valves 226 and 228.

Conversely, the cold start condition is not met when one or more of $T_{engine}$ increases above $T_{engine,TH}$ while the engine is ON (the engine is no longer under cold start conditions), $T_{ECD,j}>T_{ECD,TH}$ (the emission control device is greater than the threshold ECD temperature), and $\Delta t_{START}<\Delta t_{START,TH}$ is met (the threshold post-engine start duration after an engine start event is exceeded). Thus, responsive to the cold start condition not being met, the controller 12 shutdown the SAIR system 220 by closing one or more of the SAIR flow control valves 226 and 228 and switching OFF SAIR pump 222.

Controller 12 may measure a SAIR flow rate with the SAIR flow sensor 224 positioned within the SAIR system 220. In the example of FIG. 2, SAIR flow sensor 224 is positioned upstream from the SAIR flow control valves 226 and 228 and downstream from SAIR pump 222. As such, flow rate measurement with the SAIR flow sensor 224 may not reliably detect when SAIR is not being delivered to (or when SAIR flow is partially blocked or diverted from) the exhaust manifolds 246 and 248, in the case of a malfunction in the SAIR system (e.g., a faulty SAIR pump 222, stuck SAIR flow control valve 226 or 228, a blockage in the SAIR system 220, a leak in the SAIR system, and the like). In one example, a leak in the SAIR system 220 downstream from the SAIR flow sensor may appear non-faulty to the SAIR flow sensor 224 as SAIR is moving past the SAIR flow sensor 224 but may be at least partially diverted before reaching the exhaust manifold.

An estimate of the total SAIR delivered to the exhaust manifolds 246 and 248, and the SAIR at each of the exhaust manifolds 246 and 248 (e.g., SAIR on a per cylinder bank basis) may be back calculated from the fuel injection flow rate to each cylinder bank, $Q_{inj,j}$, the air-to-fuel ratio, AFR (measured by exhaust gas sensors 286 and 288), and the intake air flow rate, $Q_{air,intake}$ (measured by MAF sensor 46). As shown in equation (1), an estimate for the amount of air in each exhaust manifold 246 and 248 may be back calculated from the measured $AFR_J$ (AFR in exhaust manifold corresponding to $j^{th}$ cylinder bank) and the fuel flow delivered, $Q_{inj,j}$ (fuel injection flow rate to the $j^{th}$ cylinder bank).

$$Q_{air,j}=Q_{inj,j}*AFR_J \text{ [mass/cycle]} \quad (1)$$

$$Q_{air,j}=Q_{inj,j}*\lambda_j*AFR_{STOICH} \text{ [mass/cycle]} \quad (2)$$

$$Q_{inj,j}=\Sigma_i Q_{inj,j,i} \text{ [mass/cycle]} \quad (3)$$

Here, $Q_{air,j}$ represents the sum of the SAIR flow rate delivered to the exhaust manifold (corresponding to the $j^{th}$ cylinder bank) and the residual air flow rate exhausted from the $j^{th}$ bank of cylinders following cylinder combustion. In the case where the exhaust gas sensor 286 or 288 measures, λ, the ratio of the actual AFR to the stoichiometric AFR, $AFR_{STOICH}$, $Q_{air,j}$ is given by equation (2). In general, the amount of fuel and oxygen consumed by combustion is negligible relative to the total amount of fuel and oxygen exhausted. As such, equations (1) and (2) are able to provide reliable estimates for the SAIR flow rate. Furthermore, $Q_{inj,j}$ may be calculated from equation (3), where the fuel injection flow rate to the $j^{th}$ cylinder bank, $Q_{inj,j}$, is determined by summing the fuel injection flow rates to each $i^{th}$ cylinder in the $j^{th}$ bank, $Q_{inj,j,i}$. The units for $Q_{air,j}$ and $Q_{inj,j}$ are in mass units per cycle, where a cycle refers to a 4-stroke cylinder cycle, and 720 crank degrees of revolution.

Next, an estimate for SAIR delivered to the exhaust manifold may be determined by subtracting the intake airflow, $Q_{air,intake}$, from the sum over each $j^{th}$ cylinder bank of each $Q_{air,j}$, as indicated by equation (4). Furthermore, assuming the intake air, $Q_{air,intake}$, is apportioned equally amongst each $j^{th}$ cylinder bank, the SAIR delivered to each exhaust manifold corresponding to the $j^{th}$ cylinder bank, $Q_{SAIR,j}$, can be determined as represented by equation (5). Further still, an estimate of SAIR on a per cylinder basis within each bank may be calculated by dividing $Q_{SAIR,j}$ by the number of cylinders in the $j^{th}$ bank, $I_j$, as shown in equation (6).

$$Q_{SAIR}=\Sigma_j Q_{air,j}-Q_{air,intake} \text{ [mass/cycle]} \quad (4)$$

$$Q_{SAIR,j}=Q_{air,j}-Q_{air,intake,j}=Q_{air,intake}/J \text{[mass/cycle]} \quad (5)$$

$$Q_{SAIR,j,cylinder}=Q_{SAIR,j}/I_j \text{ [mass/cycle]} \quad (6)$$

In equation (5), j is the total number of cylinder banks, and $Q_{air,intake,j}$ represents the intake air flow rate delivered to the $j^{th}$ cylinder bank. In equation (6), $I_j$ represents the total number of cylinders 130 in the $j^{th}$ cylinder bank. Furthermore, conversion to units of [mass/time] can be executed by multiplying by engine speed and a factor of revolutions per cycle, as represented by equation (7).

$$Q_{SAIR,j}\text{ [mass/min]}=Q_{SAIR,j}\text{ [mass/cycle]}*\tfrac{1}{2}\text{[cycle/revolutions]*Engine Speed [rpm]} \quad (7)$$

The SAIR can also be expressed as a percentage of the total exhaust flow, either across all cylinder banks (equation (8)), or by cylinder bank (equation (9)). In equation (9), it is assumed that the intake air flow, $Q_{air,intake}$, is divided evenly across the intake manifolds corresponding to the j cylinder banks.

$$\%\ Q_{SAIR}=(Q_{SAIR}/\Sigma_j Q_{air,j})*100=[Q_{SAIR}/(Q_{SAIR}+Q_{air,intake})]*100 \quad (8)$$

$$\%\ Q_{SAIR,j}=(Q_{SAIR,j}/Q_{air,j})*100=[Q_{SAIR,j}/(Q_{SAIR,j}\ Q_{air,intake}/j)]*100 \quad (9)$$

Turning now to FIG. 3, it illustrates two data plots 310 and 320, comparing estimated SAIR flow rates, $Q_{SAIR}$ ($Q_{SAIR}$ summed over all cylinder banks, 314, 324), $Q_{SAIR,1}$ ($Q_{SAIR}$ directed to a first cylinder bank, 316, 326), and $Q_{SAIR,2}$ ($Q_{SAIR}$ directed to a second cylinder bank, 318, 328), calculated from equations (4) and (5), along with a measured flow rate, $Q_{SAIR,meas}$ (312, 322) (e.g., measured with SAIR flow sensor 224). Plot 310 illustrates engine operating conditions from a time between 0 to 12 s when SAIR is being delivered to the exhaust manifolds, and operating conditions after a time of 12 s when the SAIR is not being delivered to the exhaust manifolds. In other words, between 0 to 12 s, a first condition may be satisfied, including when a SAIR pump is ON and one or more of the SAIR flow control valves is adjusted to a more open position. The first condition may further include when a cold start condition is satisfied, including when the engine status is ON and $T_{engine}<T_{engine,TH}$, $T_{ECD,j}<T_{ECD,TH}$, and $\Delta t_{START}<\Delta t_{START,TH}$ Furthermore, after 12 s the first condition may not be satisfied, and a second condition may be satisfied, including when the SAIR pump is OFF, and all of the SAIR flow control valves are closed. The second condition may further include when the cold start condition is not satisfied, including when the engine status is OFF and $T_{engine}>T_{engine,TH}$, $T_{ECD,j}>T_{ECD,TH}$, and $\Delta t_{START}>\Delta t_{START,TH}$.

Both plots 310 and 320 illustrate that, in spite of substantial noise factors influencing the estimated data, there is reasonable agreement between the estimated and measured values of SAIR, $Q_{SAIR}$ and $Q_{SAIR,meas}$ One example noise factor may include the influence of lost fuel. Lost fuel includes fuel that does not evaporate and excludes fuel that is combusted in the air-fuel mixture. Accordingly, the lost fuel (non-evaporated fuel) is included and accounted for in the measured fuel injection flow rates, $Q_{inj,j}$, but is not measured as part of the exhaust air-fuel mixture by the exhaust gas sensors 128 (e.g., AFR measurement). Accordingly, the $Q_{air,j}$ calculated from equations (2) and (3) can deviate from the true air flow rate. Furthermore, the amount of lost fuel can vary depending on engine operating conditions such as engine temperature and soak time, whereby an amount of lost fuel increases with colder ambient temperatures and/or longer soak times. Thus, as engine operating conditions vary, noise factors such as lost fuel can fluctuate, causing variability in the $Q_{SAIR,j}$ calculated from $Q_{air,j}$ (equations (4)-(6)). Herein, the soak time refers to the duration of time in which a vehicle engine status is OFF and which precedes a successful vehicle start (a successful vehicle start is defined as a vehicle start that does not result in a stall). In one example, when the soak-time is greater than a threshold soak time, the corresponding engine start is designated as a cold start. As one example, the threshold soak time may include 12 hours.

Owing to the substantial noise in the estimated data, indication of a normally functioning SAIR system can be indicated by changes in the estimated $Q_{SAIR}$ and $Q_{SAIR,j}$. For example, the change in $Q_{SAIR}$, $\Delta Q_{SAIR}$ ($\Delta Q_{SAIR}=|Q_{SAIR1}-Q_{SAIR2}|$), can be compared with a threshold change, $\Delta Q_{SAIR,TH}$ ($\Delta Q_{SAIR,TH}$ refers to a threshold SAIR difference). Here, $Q_{SAIR1}$ and $Q_{SAIR2}$ denote an estimated SAIR flow rate, $Q_{SAIR}$ (summed over each cylinder bank, j), corresponding to when the first condition is satisfied and when the second condition is satisfied, respectively. In other words, $\Delta Q_{SAIR}$ may refer to a change in estimated SAIR flow rate before and after SAIR shutdown. In another example, $\Delta Q_{SAIR}$ may also refer to a change in estimated SAIR flow rate before and after SAIR startup. In a further example, $\Delta Q_{SAIR}$ may also refer to a change in estimated SAIR flow rate between a first condition (e.g., when the controller 12 takes action to startup the SAIR system 220 and direct SAIR to the exhaust manifold) and a second condition (e.g., when the controller 12 takes action to shut down the SAIR system 220 and stop directing SAIR to the exhaust manifold).

In one example, the duration when the first condition is satisfied and the duration when the second condition is satisfied may not be sequentially consecutive in time, whereby the second duration follows the first duration in uninterrupted succession. As an example, the duration when the first condition is satisfied and the duration when second condition is satisfied may be separated by an intervening interval of time therebetween. Furthermore, the duration when the second condition is satisfied may occur prior to the duration when the first condition is satisfied, or, the duration when the first condition is satisfied may occur prior to the duration when the second condition is satisfied. In another example, the first duration and the second duration may preferably be sequentially consecutive in time because noise factors may be reduced. For instance, the influence of lost fuel on the calculated $Q_{sair,j}$ and $Q_{SAIR}$ may be reduced since the amount of lost fuel during the first duration and the second duration may be more similar when the first duration and the second duration are sequentially consecutive in time. In the example illustrated by the plots of FIG. 3, $\Delta Q_{SAIR}$ corresponds to before and after shutdown of the SAIR system at a time of 12 s. When $\Delta Q_{SAIR}>\Delta Q_{SAIR,TH}$, the SAIR system is functioning normally; conversely, when $\Delta Q_{SAIR}<\Delta Q_{SAIR,TH}$, the SAIR system may be faulty.

In one example, $Q_{SAIR1}$ and $Q_{SAIR2}$ may be determined by averaging the measured data for $Q_{SAIR1}$ and $Q_{SAIR2}$ over a threshold duration prior to and after the SAIR system being shutdown. In one example, the threshold duration may include five seconds. In one example, $Q_{SAIR1}$ may be calculated by averaging the measured data for $Q_{SAIR1}$ over the threshold duration just prior to an engine shutdown event; $Q_{SAIR2}$ may be calculated by averaging the measured data for $Q_{SAIR2}$ over the threshold duration just after the engine shutdown event. In another example, the averaging may exclude data measured during a deadband duration just prior to and just after the engine shutdown event in order to reduce the variability arising from the transient effects of the engine shutdown event. Accordingly, $Q_{SAIR1}$ may be calculated by averaging the measured data for $Q_{SAIR1}$ over the threshold duration just prior to the deadband duration before an engine shutdown event; $Q_{SAIR2}$ may be calculated by averaging the measured data for $Q_{SAIR2}$ over the threshold duration just after the deadband duration following the engine shutdown event.

Furthermore, $\Delta Q_{SAIR,TH}$ may be a predetermined based on a set point SAIR. For example, $\Delta Q_{SAIR,TH}$ may include 50% of the desired SAIR. In this way, $\Delta Q_{SAIR,TH}$ may vary with engine operating conditions. For example, at higher engine loads (e.g., higher $Q_{in}$), the exhaust may contain higher levels of uncombusted fuel; thus, the desired SAIR may be higher to aid in oxidizing the higher amounts of uncombusted fuel in the exhaust. In another example, $\Delta Q_{SAIR,TH}$ may be determined based on emissions data that correlates SAIR with exhaust emissions. In other words, $\Delta Q_{SAIR,TH}$ may be chosen to aid in maintaining exhaust emissions below a threshold level. Additionally or alternatively, $\Delta Q_{SAIR,TH}$ may be determined based on tolerances and sensitivities, and measurement ranges of the measurement sensors such as the exhaust gas sensors, manifold pressure sensors, SAIR flow sensors, and the like. For instance, $\Delta Q_{SAIR,TH}$ may be higher when the measurement error for the sensors is higher. In one example, when the ECD temperature is lower and/or the vehicle engine soak time is longer, $\Delta Q_{SAIR,TH}$ may be reduced since underdelivering SAIR by more than $\Delta Q_{SAIR,j,TH}$ increases a probability of exceeding emissions thresholds.

In another example, the change (e.g., before and after shutdown of the SAIR system, or before and after startup of the SAIR system) in $Q_{SAIR,j}$, $\Delta Q_{SAIR,j}$, can be compared with a threshold change, $\Delta Q_{SAIR,TH,j}$ ($\Delta Q_{SAIR,j}=|Q_{SAIR1,j}-Q_{SAIR2,j}|$). $Q_{SAIR,j}$ refers to the SAIR directed to the $j^{th}$ engine cylinder bank. When $\Delta Q_{SAIR,j}>\Delta Q_{SAIR,j,TH}$, the SAIR system is functioning normally; conversely, when $\Delta Q_{SAIR,j}<\Delta Q_{SAIR,j,TH}$, the SAIR system may be faulty. In one example, $Q_{SAIR1,j}$ and $Q_{SAIR2,j}$ may be determined by averaging the $Q_{SAIR1,j}$ and $Q_{SAIR2,j}$ data over the threshold duration (e.g., prior to and after the SAIR system being shut down or prior to and after the SAIR system being started up). Furthermore, $\Delta Q_{SAIR,j,TH}$ may be a predetermined based on a set point SAIR corresponding to the $j^{th}$ bank. For example, $\Delta Q_{SAIR,j,TH}$ may include 50% of the desired SAIR for the $j^{th}$ bank. In this way, $\Delta Q_{SAIR,j,TH}$ may vary with engine operating conditions, and may also be determined on a per cylinder bank basis, to account for differences in fuel injection flow rates, compression ratio, and the like between each cylinder bank.

In another example, a difference in SAIR directed to the exhaust of two cylinder banks, $\Delta Q_{SAIR,j,j+1}$ ($\Delta Q_{SAIR,j,j+1}=|Q_{SAIR,j}-Q_{SAIR,j+}|$), can be compared, both before and after shutdown (or before and after startup) of the SAIR system. When $\Delta Q_{SAIR,j,j+1}<\Delta Q_{SAIR,j,j+1,TH}$ ($\Delta Q_{SAIR,j,j+1,TH}$ refers to a threshold bank-bank SAIR difference), the SAIR system is functioning normally; conversely, when $\Delta Q_{SAIR,j,j+1}>\Delta Q_{SAIR,j,j+1,TH}$, the SAIR system may be faulty. In one example, $Q_{SAIR,j}$ and $Q_{SAIR,j+1}$ may be determined by averaging the $Q_{SAIR,j}$ and $Q_{SAIR,j+1}$ data, respectively, over the threshold duration prior to and/or after the SAIR system being shutdown.

Furthermore, $\Delta Q_{SAIR,j,j+1,TH}$ may be a predetermined based on a set point SAIR corresponding to the $j^{th}$ and $(j+1)^{th}$ bank. For example, $\Delta Q_{SAIR,j,j+1,TH\ may\ include}$ 50% of the desired SAIR,j for the $j^{th}$ bank or $(j+1)^{th}$ bank. In this way, $\Delta Q_{SAIR,j,j+1,TH}$ may vary with engine operating conditions and may account for differences in operating conditions between the $j^{th}$ and $(j+1)^{th}$ cylinder bank.

$\Delta Q_{SAIR,j,TH}$ and $\Delta Q_{SAIR,j,j+1,TH}$ may be determined based on engine operating conditions, as described above for $\Delta Q_{SAIR,TH}$. For instance, $\Delta Q_{SAIR,j,TH}$ (or $\Delta Q_{SAIR,j,j+1,TH}$) may be a predetermined based on a set point SAIR. For example, $\Delta Q_{SAIR,j,TH}$ (or $\Delta Q_{SAIR,j,j+1,TH}$) may include 50% of the desired SAIR. In this way, $\Delta Q_{SAIR,j,TH}$ (or $\Delta Q_{SAIR,j,j+1,TH}$) may vary with engine operating conditions. For example, at higher engine loads (e.g., higher $Q_{inj}$), the exhaust may contain higher levels of uncombusted fuel; thus, the desired SAIR may be higher to aid in oxidizing the higher amounts of uncombusted fuel in the exhaust. In another example, $\Delta Q_{SAIR,j,TH}$ (or $\Delta Q_{SAIR,j,j+1,TH}$) may be determined based on emissions data that correlates SAIR with exhaust emissions. In other words, $\Delta Q_{SAIR,j,TH}$ (or $\Delta Q_{SAIR,j,j+1,TH}$) may be chosen to aid in maintaining exhaust emissions below a threshold level. Additionally or alternatively, $\Delta Q_{SAIR,j,TH}$ (or $\Delta Q_{SAIR,j,j+1,TH}$) may be determined based on tolerances and sensitivities, and measurement ranges of the measurement sensors such as the exhaust gas sensors, manifold pressure sensors, SAIR flow sensors, and the like. For instance, $\Delta Q_{SAIR,j,TH}$ (or $\Delta Q_{SAIR,j,j+1,TH}$) may be higher when the measurement error for the sensors is higher. In one example, when the ECD temperature is lower and/or the vehicle engine soak time is longer, $\Delta Q_{SAIR,j,TH}$ (or $\Delta Q_{SAIR,j,j+1,TH}$) may be reduced since underdelivering SAIR by more than $\Delta Q_{SAIR,j,TH}$ increases a probability of exceeding emissions thresholds.

In another example, a sum of the estimated SAIR across all cylinder banks, $Q_{SAIR}=, \Sigma Q_{SAIR,j}$, may be compared with $Q_{SAIR,meas}$. When $\Delta Q_{SAIR,mease,est}=Q_{SAIR,meas}-\Sigma Q_{SAIR,j}$ is greater than a threshold difference, $\Delta Q_{SAIR,mease,est,TH}$, a substantial portion of the SAIR delivered by SAIR pump may not be delivered to the exhaust manifold, indicating a faulty SAIR system. $Q_{SAIR,meas}-\Sigma Q_{SAIR,j}$ may be compared both before and after shutdown, and $\Delta Q_{SAIR,mease,est}$ may be dependent on the values of $\Delta Q_{SAIR,mease,est}$ before and after shutdown.

The plot 310 shows $Q_{SAIR}$ estimates for a non-faulty SAIR system. As such $\Delta Q_{SAIR}>\Delta Q_{SAIR,TH}$, $\Delta Q_{SAIR,j}>\Delta Q_{SAIR,j,TH}$ (for both cylinder banks), and $\Delta Q_{SAIR,j,j+1}<\Delta Q_{SAIR,j,j+1,TH}$. In contrast, plot 320 shows $Q_{SAIR}$ estimates for a faulty SAIR system. In particular, the change in $Q_{SAIR,2}$ ($\Delta Q_{SAIR,2}=|Q_{SAIR1,2}-Q_{SAIR2,2}|$) before and after the SAIR shutdown at 12 s is much lower than the corresponding change to $Q_{SAIR,1}$, ($\Delta Q_{SAIR,1}=|Q_{SAIR1,1}-Q_{SAIR2,1}|$). As such, $\Delta Q_{SAIR,2}<\Delta Q_{SAIR,2,TH}$ and $\Delta Q_{SAIR1,1,2}<\Delta Q_{SAIR1,i,j+1,TH}$, indicating a faulty SAIR system, specifically, a faulty SAIR system corresponding to cylinder bank 2. For example, a SAIR flow control valve delivering SAIR to the exhaust of cylinder bank 2 may be stuck in a closed position. Furthermore, $\Delta Q_{SAIR,mease,est}, =Q_{SAIR,meas}-\Sigma Q_{SAIR,j}$ may be greater than a threshold difference, $\Delta Q_{SAIR,mease,est,TH}$, because a substantial portion of the SAIR delivered by SAIR pump is not be delivered to the exhaust manifold.

In another example, a SAIR ratio, $Q_{SAIR,ratio12}=Q_{SAIR1}/Q_{SAIR2}$, of the estimated SAIR before shutdown of the SAIR system to the estimated SAIR after shutdown of the SAIR system may be calculated to determine if the SAIR system is faulty. Utilizing a SAIR flow ratio, $Q_{SAIR,ratio12}$, may advantageously aid in reducing an influence of noise factors in diagnosing the SAIR system. For the case where $Q_{SAIR,ratio12}$ is less than a lower threshold SAIR ratio, $Q_{SAIR,ratio,TH,lower}$, a faulty SAIR system is indicated. $Q_{SAIR,ratio12}<Q_{SAIR,ratio,TH,lower}$ may be caused by a one or more of a lower than expected $Q_{SAIR1}$ and a higher than expected $Q_{SAIR2}$. A lower than expected $Q_{SAIR1}$ (SAIR flow during the first condition when the SAIR system is ON) may be caused by one or more of a blockage in the SAIR system, a leak in the SAIR system, or a stuck SAIR flow control valve in a more closed position, that lowers SAIR flow, $Q_{SAIR1}$, to the exhaust manifold. A higher than expected $Q_{SAIR2}$ (SAIR flow during the second condition when the SAIR system is OFF) may be caused by one or more of a stuck SAIR flow control valve in a more open position, and a faulty SAIR pump that doesn't shut OFF, that prevents stopping of the SAIR flow to the exhaust manifold.

In another example, a SAIR ratio, $Q_{SAIR,ratio12}=Q_{SAIR1}/Q_{SAIR2}$, of the estimated SAIR before shutdown of the SAIR system to the estimated SAIR after shutdown of the SAIR system may be compared with an upper threshold SAIR ratio, $Q_{SAIR,ratio,TH,upper}$. For the case where $Q_{SAIR,ratio12}>Q_{SAIR,ratio,TH,upper}$, a faulty SAIR system is indicated. $Q_{SAIR,ratio12}>Q_{SAIR,ratio,TH,upper}$ may be caused by a higher than expected $Q_{SAIR1}$. A higher than expected $Q_{SAIR1}$ (SAIR flow during the first condition when the SAIR system is ON) may be caused by a faulty SAIR pump that is operating at a higher than expected pump speed and that raises SAIR flow, $Q_{SAIR1}$, to the exhaust manifold. In another example, the SAIR ratio may be applied on a cylinder bank basis. In other words, a SAIR ratio by cylinder bank, $Q_{SAIR,ratio12,j}=Q_{SAIR1,j}/Q_{SAIR2,j}$ may be compared with upper and lower threshold SAIR ratios, $Q_{SAIR,ratio,TH,upper,j}$ and $Q_{SAIR,ratio,TH,lower,j}$, respectively, corresponding to the $j^{th}$ cylinder bank. When $Q_{SAIR,ratio12,j}<Q_{SAIR,ratio,TH,lower,j}$ or when $Q_{SAIR,ratio12,j}>Q_{SAIR,ratio,TH,upper,j}$, a faulty SAIR system corresponding to SAIR flow at the $j^{th}$ cylinder bank may be indicated. Conditions giving rise to when $Q_{SAIR,ratio12,j}<Q_{SAIR,ratio,TH,lower,j}$ or when $Q_{SAIR,ratio12,j}>Q_{SAIR,ratio,TH,upper,j}$, may be as described above for $Q_{SAIR,ratio12}<Q_{SAIR,ratio,TH,lower}$ and $Q_{SAIR,ratio12}>Q_{SAIR,ratio,TH,upper}$, but as applied on a per $j^{th}$ cylinder bank basis. Furthermore, the SAIR ratio may further include a ratio comparing SAIR flows from two different cylinder banks. For example, $Q_{SAIR,ratio12,j,j+1}=Q_{SAIR1,j}/Q_{SAIR2,j+1}$, may be compared with thresholds, $Q_{SAIR,ratio,j,j+1,TH,lower}$ and $Q_{SAIR,ratio,j,j+1,TH,upper}$ to diagnose a faulty SAIR system.

Turning now to FIG. 7, it illustrates data plots 700 and 710. Similar to data plot 310, data plot 700 compares estimated total SAIR flow rate 708, estimated SAIR flow rate 704 for a first cylinder bank, and estimated SAIR flow rate 706 for a second cylinder bank, with the measured total SAIR flow rate 702 (e.g., measured with SAIR flow sensor 224). In contrast, during the same time period, data plot 710 compares estimated SAIR flow rates as a percentage of total exhaust flow, % $Q_{SAIR,1}$ (% $Q_{SAIR}$ directed to a first cylinder bank, 714), and $Q_{SAIR,2}$ ($Q_{SAIR}$ directed to a second cylinder bank, 716), calculated from equation (9), along with a measured % SAIR flow rate, % $Q_{SAIR,meas}$ (712) (e.g., % $Q_{SAIR,meas}=Q_{SAIR,meas}/(Q_{SAIR,meas}+Q_{air,intake})$, $Q_{SAIR,meas}$ measured with SAIR flow sensor 224). Plot 710 illustrates engine operating conditions from a time between 0 to about 15 s when SAIR is being delivered to the exhaust manifolds, and operating conditions after a time of 15 s when the SAIR is not being delivered to the exhaust manifolds. In other words, between 0 to 15 s, a first condition may be satisfied, including when a SAIR pump is ON and one or more of the SAIR flow control valves is adjusted to a more open position. The first condition may further include when a cold start condition is satisfied, including when the engine status is ON and $T_{engine}<T_{engine,TH}$, $T_{ECD,j}<T_{ECD,TH}$, and $\Delta t_{START}<\Delta t_{START,TH}$. Furthermore, after 15 s the first condition may not be satisfied, and a second condition may be satisfied, including when the SAIR pump is OFF, and all of the SAIR flow control valves are closed. The second condition may further include when the cold start condition is not satisfied, including when the engine status is OFF and $T_{engine}>T_{engine,TH}$, $T_{ECD,j}>T_{ECD,TH}$, and $\Delta t_{START}>\Delta t_{START,TH}$.

Comparison of the plot 710 with the plots 710, (and plots 310 and 320) show that expressing the SAIR flow as a percentage of the exhaust flow, % $Q_{SAIR}$ may additionally or alternatively be utilized to diagnose faults in the SAIR system 220. Furthermore, expressing the estimated SAIR flow as % $Q_{SAIR}$ may aid in reducing the influence of noise factors, including lost fuel, as indicated by the smaller amplitude signal fluctuations in the trend lines of plot 710, as compared with the data plots in FIG. 3. Threshold-based criteria for diagnosing a faulty SAIR system can be analogously described for % $Q_{SAIR}$ and % $Q_{SAIR,j}$ values as described above for $Q_{SAIR}$ and $Q_{SAIR,j}$ with reference to the plots of FIG. 3. The data plots 700 and 710 illustrate $Q_{SAIR}$ and % $Q_{SAIR}$ estimates, respectively, for a non-faulty SAIR system. As such, with reference to data plot 710, A % $Q_{SAIR}>$A % $Q_{SAIR,TH}$, $\Delta$ % $Q_{SAIR,j}>\Delta$ % $Q_{SAIR,j,TH}$ (for both cylinder banks), and $\Delta$ % $Q_{SAIR,i,j+1}<\Delta$ % $Q_{SAIR,j,j+1,TH}$. Here, $\Delta$ % $Q_{SAIR}=|\%-\%\ Q_{SAIR2}|$, $\Delta$ % $Q_{SAIR1,j}-\%\ Q_{SAIR2,j}|$, and $\Delta$ % $Q_{SAIR,j,j+1}=|\%\ Q_{SAIR,j}-\%\ Q_{SAIR,j+1}|$. Furthermore, $\Delta$ % $Q_{SAIR,TH}$ may be described and determined analogously to $\Delta Q_{SAIR,TH}$, $\Delta$ % $Q_{SAIR,j,TH}$ may be described and determined analogously to $\Delta Q_{SAIR,j,TH}$, and $\Delta$ % $Q_{SAIR,j,j+1,TH}$ (bank-bank percent SAIR difference) may be described and determined analogously to $\Delta Q_{SAIR,j,j+1,TH}$. In contrast, a faulty SAIR system may be indicated by one or more of when $\Delta$ % $Q_{SAIR}<\Delta$ % $Q_{SAIR,TH}$, $\Delta$ % $Q_{SAIR,j}<\Delta$ % $Q_{SAIR,j,TH}$ (for both cylinder banks), and $\Delta$ % $Q_{SAIR,j,j+1}<\Delta$ % $Q_{SAIR,j,j+1,TH}$.

Turning now to FIGS. 4 and 5, flow charts representing methods 400 and 500 are shown for operating an engine system 200, including an engine 10 and SAIR system 220 of a vehicle 5. The methods of FIGS. 4 and 5 are directed to determining degradation of a SAIR system adding a SAIR to downstream of an engine cylinder exhaust based on a comparison of the SAIR determined from a fuel injection amount, an exhaust air-fuel ratio, and an engine intake airflow, both before and after shutdown of the SAIR pump. Furthermore, the degradation of the SAIR system can be determined on a per cylinder bank basis so that a fault in the SAIR system may be indicated as corresponding to one or more particular cylinder banks. Instructions for carrying out the methods 400 and 500 may be executed by a controller 12 based on instructions stored on a memory of the controller 12 and in conjunction with signals received from sensors of the engine, such as the sensors described above with reference to FIGS. 1 and 2. The controller 12 may employ engine actuators of the engine 10 to adjust engine operation, according to the methods described below.

At 410, method 400 includes estimating and/or measuring engine operating conditions. The engine operating conditions may include, for example, engine ON/OFF status, SAIR pump ON/OFF status, $Q_{SAIR,meas}$, $AFR_j$, $Q_{inj,j}$, $Q_{air,intake}$, % opening position of SAIR flow control valves, $T_{engine}$, $T_{ECD}$, $\Delta t_{START}$, and the like. The engine operating conditions may be measured by one or more sensors communicatively coupled to the controller 12 or may be inferred based on available data. For example, the engine temperature may be measured by an engine coolant temperature sensor, such as ECT sensor 112 of FIG. 1, and the ECD temperature may be measured by an ECD temperature sensor. As yet another example, the accelerator pedal position may be measured by an accelerator pedal position sensor, such as accelerator pedal position sensor 118 of FIG. 1, and the brake pedal position may be measured by a brake pedal position sensor, such as brake pedal position sensor 119 of FIG. 1. Together, the accelerator pedal position and the brake pedal position may indicate a demanded amount of engine torque.

Next, method 400 continues at 420 where the controller 12 determines if a first condition is satisfied. The first condition being satisfied includes when a SAIR pump is ON. The first condition may further include when one or more of the SAIR flow control valves 226 and 228 are open. Furthermore, the first condition may further include when a cold start engine event has occurred (e.g., and a cold start condition is satisfied), including when the engine status is ON and $T_{engine}<T_{engine,TH}$. Furthermore, the cold start condition may further include when $T_{ECD,j}<T_{ECD,TH}$ and/or when $\Delta\Delta t_{START}<\Delta t_{START,TH}$. For the case where the first condition is satisfied, method 400 continues at 422, 424, and 426, where the controller 12 measures the fuel injection flow, $Q_{inj,j,i}$, for each $i^{th}$ cylinder in each $j^{th}$ cylinder bank, $\lambda_j$ at the exhaust manifold for each $j^{th}$ cylinder bank, and $Q_{air,intake}$, respectively, corresponding to when the first condition is satisfied. As described earlier, $Q_{inj,j,i}$, $\lambda_j$, and $Q_{air,intake}$ may be determined by averaging measured data received from signals and sensors (e.g., FPW signal from driver 168, exhaust gas sensors 128, 286 and 288, and MAF sensor 46). In particular, the measured data may be averaged over a threshold duration during conditions when the first condition is satisfied. Averaging the measure data over the threshold duration may aid in reducing an influence of noise factors, and can increase the reliability of the method 400. Next, method 400 continues at 428 where the controller 12 calculates $Q_{SAIR1}$ and $Q_{SAIR1,j}$ (e.g., $Q_{SAIR}$ and $Q_{SAIR,j}$ when the first condition is satisfied), from equations (1) through (6).

Returning to 420, for the case where the first condition is not satisfied, method 400 continues at 430 where the controller 12 determines if a second condition is satisfied. The second condition being satisfied includes when a SAIR pump is OFF. The second condition may further include when one or more of the SAIR flow control valves 226 and 228 are fully closed. Furthermore, the second condition may further include when a cold start engine event has ended (e.g., and when a cold start condition is not satisfied), including when the engine status is ON and $T_{engine}>T_{engine,TH}$. Furthermore, the cold start condition not being satisfied may further include when $T_{ECD,j}>T_{ECD,TH}$ and/or when $\Delta\Delta t_{START}>\Delta t_{START,TH}$. For the case where the second condition is satisfied, method 400 continues at 432, 434, and 436, where the controller 12 measures the fuel injection flow, $Q_{inj,j,i}$, for each $i^{th}$ cylinder in each $j^{th}$ cylinder bank, $\lambda_j$ for each $j^{th}$ cylinder bank, and $Q_{air,intake}$, respectively, corresponding to when the second condition is satisfied. As described earlier, $Q_{inj,j,i}$, $\lambda_j$, and $Q_{air,intake}$ may be determined by averaging measured data received from signals and sensors (e.g., FPW signal from driver 168, exhaust gas sensors 128, 286 and 288, and MAF sensor 46). In particular, the measured data may be averaged over threshold duration when the second condition is satisfied. Averaging the measure data over the threshold duration may aid in reducing an influence of noise factors, and can increase the reliability of the method 400. Next, method 400 continues at 438 where the controller 12 calculates $Q_{SAIR2}$ and $Q_{SAIR2,j}$ (e.g., $Q_{SAIR}$ and $Q_{SAIR,j}$ when the second condition is satisfied), from equations (1) through (6).

After 428 and 438, method 400 continues at 440, where the controller 12 determines if a SAIR system degradation condition is satisfied, as shown in FIG. 5. Turning now to FIG. 5, method 500 begins at 520 where the controller 12 determines if $\Delta Q_{SAIR}<\Delta Q_{SAIR,TH}$, whereby $\Delta Q_{SAIR}$ refers to a difference between $Q_{SAIR1}$ ($Q_{SAIR}$ during the first condition) and $Q_{SAIR2}$ ($Q_{SAIR}$ during the second condition). For the case where $\Delta Q_{SAIR}<\Delta Q_{SAIR,TH}$, method 500 continues to 524 where the controller 12 indicates degradation at the SAIR system. In one example, $\Delta Q_{SAIR,TH}$ may include a percentage of $Q_{SAIR,meas}$, such as 80% of $Q_{SAIR,meas}$. In another example, $Q_{SAIR1,TH}$ may depend on $Q_{SAIR,meas}$ and the number of cylinders 130. For example, if the number of cylinders is I, $\Delta Q_{SAIR,TH}$ may be $(1-1/I)*Q_{SAIR,meas}$; as such, for the case of a 4-cylinder engine, $\Delta Q_{SAIR,TH}=0.75*Q_{SAIR,meas}$.

For the case where $\Delta Q_{SAIR}>\Delta Q_{SAIR,TH}$, method 500 continues to 530 where the controller 12 determines if $\Delta Q_{SAIR,j}<\Delta Q_{SAIR,j,TH}$, whereby $\Delta Q_{SAIR,j}$ refers to a difference between $Q_{SAIR1,j}$ ($Q_{SAIR,j}$ during the first condition) and $Q_{SAIR2,j}$ ($Q_{SAIR,j}$ during the second condition). For the case where $\Delta Q_{SAIR,j}<\Delta Q_{SAIR,j,TH}$, method 500 continues to 534 where the controller 12 indicates degradation at the SAIR system, in particular, degradation at the SAIR system corresponding to the $j^{th}$ cylinder bank.

For the case where $\Delta Q_{SAIR,j}>\Delta Q_{SAIR,j,TH}$, method 500 continues to 540 where the controller 12 determines if $\Delta Q_{SAIR1,j,j+1}>\Delta Q_{SAIR1,j,j+1,TH}$, whereby $\Delta Q_{SAIR1,j,j+1}$ refers to a difference between $Q_{SAIR1,j}$ ($Q_{SAIR,j}$ during the first condition) and $Q_{SAIR1,j+1}$ ($Q_{SAIR,j+}$ during the first condition). For the case where $\Delta Q_{SAIR1,j,j+1}>\Delta Q_{SAIR1,j,j+1,TH}$, method 500 continues to 544 where the controller 12 indicates degradation at the SAIR system, in particular, degradation at the SAIR system corresponding to the $(j+1)^{th}$ cylinder bank. In one example, $\Delta Q_{SAIR1,j,j+1}>\Delta Q_{SAIR1,j,j+1,TH}$ may indicate that the SAIR flow control valve directing SAIR to the exhaust manifold downstream of the $(j+1)^{th}$ cylinder bank is faulty; for example, the valve may not be opening, resulting in low or no SAIR to the exhaust manifold downstream of the $(j+1)^{th}$ cylinder bank. At 540, the controller 12 may evaluate $\Delta Q_{SAIR1,j,j+1}$ for each combination of pairs of cylinder banks, j and j+1 in the engine 10.

For the case where $\Delta Q_{SAIR1,j,j+1}<\Delta Q_{SAIR1,j,j+1,TH}$, method 500 continues to 550 where the controller 12 determines if $\Delta Q_{SAIR2,i,j+1}>\Delta Q_{SAIR2,j,j+1,TH}$, whereby $\Delta Q_{SAIR2,j,j+1}$ refers to a difference between $Q_{SAIR2,j}$ ($Q_{SAIR,j}$ during the second condition) and $Q_{SAIR2,j+1}$ ($Q_{SAIR2,j+1}$ during the second condition). For the case where $\Delta Q_{SAIR1,j,j+1}>\Delta Q_{SAIR2,j,j+1,TH}$, method 500 continues to 554 where the controller 12 indicates degradation at the SAIR system, in particular, degradation at the SAIR system corresponding to the $(j)^{th}$ cylinder bank. In one example, $\Delta Q_{SAIR2,j,j+1}>\Delta Q_{SAIR2,j,j+1,TH}$ may indicate that both the SAIR pump and the SAIR flow control valve directing SAIR to the exhaust manifold downstream of the $(j)^{th}$ cylinder bank is faulty; for example, the valve may not be closing and the SAIR pump may remain ON (despite being switched OFF) resulting non-zero SAIR to the exhaust manifold downstream of the $(j)^{th}$ cylinder bank. At 540, the controller 12 may evaluate $\Delta Q_{SAIR2,j,j+1}$ for each combination of pairs of cylinder banks, j and j+1 in the engine 10.

After 550, for the case where $\Delta Q_{SAIR2,j,j+1}<\Delta Q_{SAIR2,j,j+1,TH}$, and following 524, 534, 544, and 554, method 500 returns to method 400 after 440. For the case where SAIR system degradation condition is satisfied, method 500 continues to 444 where the controller 12 generates an indication at the vehicle 5 notifying the operator of the degraded SAIR system. Returning to 440, for the case where the SAIR system degradation condition is not satisfied, method 500 continues to 448 where the controller 12 generates an indication at the vehicle 5 notifying the operator of the non-faulty SAIR system. In one example, the controller 12 may notify the operator of a degraded or not degraded SAIR system by generating one or more of an audio, visual, and a haptic indication at an instrument panel or dashboard of the vehicle (not shown in FIG. 1). After 444 and 448, method 400 ends.

In this manner, a method for monitoring a secondary airflow (SAIR) system in an engine includes, determining a degradation of the SAIR system adding a SAIR to downstream of an engine cylinder exhaust based on a comparison of the SAIR before and after a shutdown of a SAIR pump, the SAIR calculated from a fuel injection amount, an exhaust air-fuel ratio, and an engine intake airflow. In a first example, the method further includes determining the degradation of the SAIR system responsive to a difference between the SAIR before the shutdown of the SAIR pump and the SAIR after the shutdown of the SAIR pump being less than a threshold SAIR difference. In a second example, optionally including the first example, the method further includes determining the degradation of a the SAIR system responsive to a difference between the SAIR corresponding to a first bank of engine cylinders and the SAIR corresponding to a second bank of engine cylinders being greater than a threshold bank-bank SAIR difference. In a third example, optionally including one or more of the first and second examples, the method further includes determining the degradation of a SAIR valve directing the SAIR to a first bank of engine cylinders responsive to a difference between the SAIR from the first bank of engine cylinders before the shutdown of the SAIR pump and the SAIR from the first bank of engine cylinders after the shutdown of the SAIR pump being less than a threshold first bank SAIR difference. In a fourth example, optionally including one or more of the first through third examples, the method further includes measuring the exhaust air-fuel ratio downstream of the engine cylinder exhaust with an exhaust gas sensor, and calculating an exhaust airflow in the engine cylinder exhaust based on the exhaust air-fuel ratio and the fuel injection amount. In a fifth example, optionally including one or more of the first through fourth examples, the method further includes calculating the SAIR from a difference between the exhaust airflow in the engine cylinder exhaust and the engine intake airflow. In a sixth example, optionally including one or more of the first through fifth examples, the method further includes measuring the exhaust air-fuel ratio in an exhaust from each cylinder bank of the engine, calculating an exhaust airflow from each cylinder bank of the engine from the exhaust air-fuel ratio and the fuel injection amount delivered to each cylinder bank, and calculating the SAIR at the exhaust from each cylinder bank from a difference between the exhaust airflow from each cylinder bank and the intake airflow. In a seventh example, optionally including one or more of the first through sixth examples, the method further includes turning on the SAIR pump responsive to a cold start condition being met, including when a cold start engine event has occurred, and shutting down the SAIR pump responsive to the cold start condition not being met, the cold start condition not being met including when an engine temperature increases above a threshold engine temperature. In an eighth example, optionally including one or more of the first through seventh examples, the method further includes, wherein the cold start condition not being met further includes when a threshold duration following the cold start engine event is exceeded.

In another representation, optionally including one or more of the first through eighth examples, the method further includes calculating a percent SAIR from a ratio of the calculated SAIR to the exhaust airflow in the engine cylinder exhaust, and determining a degradation of the SAIR system based on a difference between the percent SAIR before the shutdown of the SAIR pump and the percent SAIR after the shutdown of the SAIR pump being less than a threshold percent SAIR difference. In another representation, optionally including one or more of the first through eighth examples, the method further includes determining a degradation of the SAIR system based on a SAIR ratio being less than a lower threshold SAIR ratio, the SAIR ratio calculated from the SAIR before the shutdown of the SAIR pump divided by the SAIR after shutdown of the SAIR pump. In another representation, optionally including one or more of the first through eighth examples, the method further includes determining a degradation of the SAIR system based on a SAIR ratio being greater than an upper threshold SAIR ratio, the SAIR ratio calculated from the SAIR before the shutdown of the SAIR pump divided by the SAIR after shutdown of the SAIR pump.

In this manner, a method for an engine includes turning on a secondary airflow (SAIR) pump to direct intake air to a SAIR system responsive to a first condition being met, turning off the SAIR pump responsive to a second condition being met, and determining a degradation of the SAIR system based on a comparison of a SAIR flow rate at an exhaust manifold during the first condition and during the second condition, the SAIR flow rate calculated from a fuel injection amount, an exhaust air-fuel ratio, and an engine intake airflow. In a first example, the method further includes, wherein the first condition includes when the engine is cold started. In a second example, optionally including the first example, the method further includes, wherein the second condition includes when an engine temperature exceeds a threshold engine temperature. In a second example, optionally including the first example, the method further includes, wherein the second condition includes when an engine temperature exceeds a threshold engine temperature. In a third example, optionally including one or more of the first and second examples, the method further includes, wherein the second condition includes when a threshold duration following the engine being cold started elapses. In a third example, optionally including one or more of the first and second examples, the method further includes indicating the degradation of the SAIR system responsive to a difference between the SAIR during the second condition and the SAIR during the first condition being less than a threshold SAIR difference.

In another representation, optionally including one or more of the first through third examples, the method further includes, wherein the comparison of the SAIR flow rate at the exhaust manifold during the first condition and during the second condition includes determining a difference between the SAIR flow rate during the first condition and the SAIR flow rate during the second condition. In another representation, optionally including one or more of the first through third examples, the method further includes, wherein the comparison of the SAIR flow rate at the exhaust manifold during the first condition and during the second condition includes determining a SAIR ratio, the SAIR ratio calculated by dividing the SAIR flow rate during the first condition by the SAIR flow rate during the second condition.

Turning now to FIG. 6, it illustrates a timeline 600 for operating an engine system 200, including an engine 10 and SAIR system 220 of a vehicle 5, according to the methods 400 and 500. In the example of FIG. 6, engine 10 includes two cylinder banks, however, in other examples engine 10 may include fewer or more cylinder banks. Similarly, in the example of FIG. 6, engine system 200 includes two exhaust manifolds and a SAIR system 220 with two SAIR flow control valves, however, in other examples engine system 200 may include fewer or more exhaust manifolds and SAIR flow control valves. Trend lines are shown for a first condition status 610, a second condition status 620, $Q_{SAIR,1}$ 630 and $Q_{SAIR,2}$ 636, $Q_{SAIR}$, SAIR degradation condition status 650, SAIR pump status 660, SAIR valve positions 670 and 680, engine (ON/OFF) status 690, $T_{engine}$ 692, $T_{ECD1}$ 696, and $T_{ECD2}$ 698 ($T_{ECD1}$ refers to the ECD in the exhaust downstream from cylinder bank 1 and $T_{ECD2}$ refers to the ECD in the exhaust downstream from the cylinder bank 2). Also shown are threshold values for $\Delta Q_{SAIR,TH}$ 642, $\Delta Q_{SAIR,j,TH}$ 631, $\Delta Q_{SAIR1,j,j+1,TH}$ 632, $\Delta Q_{SAIR2,j,j+1,TH}$ 633, $T_{engine,TH}$ 695, $T_{ECD,TH}$ 699, and $\Delta t_{start,TH}$ 691.

For clarity, the example timeline 600 depicts smooth (e.g. flat) trend lines for the calculated $Q_{SAIR,1}$, $Q_{SAIR,2}$, and $Q_{SAIR}$, however, in other examples the values for $Q_{SAIR,1}$, $Q_{SAIR,2}$, and $Q_{SAIR}$ may fluctuate (as illustrated in FIG. 3) since $AFR_j$, $Q_{inj,j}$, and $Q_{air,intake}$ may fluctuate during engine operation as engine operating conditions such as engine load, engine speed, torque, and the like, also change.

At time t=0, the engine is cold started, and the engine status switches from OFF to ON. Responsive to the cold engine start, $T_{engine}<T_{engine,TH}$, $T_{ECD1}<T_{ECD,TH}$, and $T_{ECD2}<T_{ECD,TH}$, the controller 12 switches ON the SAIR pump and opens both of the SAIR flow control valves to direct SAIR to the exhaust manifolds downstream from both cylinder banks. Thus, at time t=0, the first condition is satisfied and the second condition is not satisfied. Responsive to the first condition being satisfied, controller 12 measures $Q_{inj,j}$, $Q_{air,intake}$, and $\lambda_j$, and begins estimating $Q_{SAIR1,1}$, $Q_{SAIR1,2}$ and $Q_{SAIR1}$ ($Q_{SAIR1}$ refers to $Q_{SAIR}$ when the first condition is satisfied) from equations (1) to (6). The calculated values $Q_{SAIR1,1}$, $Q_{SAIR1,2}$, and $Q_{SAIR1}$ are at higher levels between times t=0 and t1. Between times t=0 and t1, $T_{engine}$, $T_{ECD1}$, and $T_{ECD2}$ begin to increase as the vehicle 5 is operated and the engine 10 warms up. From time t=0 to time t1, a difference between $Q_{SAIR1,1}$ and $Q_{SAIR1,2}$, $\Delta Q_{SAIR1,1,2}$ is less than a threshold difference, $\Delta Q_{SAIR1,j,j+1,TH}$ 634. As such, the SAIR degradation condition is not satisfied.

At time t1, the threshold duration, $\Delta t_{start,TH}$ 691 is exceeded, the engine status remains ON, $T_{engine}$ increases beyond $T_{engine,TH}$, and both $T_{ECD1}$ and $T_{ECD2}$ increase beyond $T_{ECD,TH}$, each (individually or in combination) signaling end of the engine cold start event. Responsive to the end of the cold start event at time t1, controller 12 switches OFF the SAIR pump, and closes the SAIR flow control valves. As such, at time t1, the first condition is no longer satisfied, and the second condition is satisfied. Controller 12 continues to measure $Q_{inj,j}$, $Q_{air,intake}$, and $\lambda_j$, and estimates $Q_{SAIR2,1}$, $Q_{SAIR2,2}$ and $Q_{SAIR2}$ ($Q_{SAIR2}$ refers to $Q_{SAIR}$ when the second condition is satisfied) from equations (1) to (6). Responsive to the SAIR pump being switched OFF and closing of the SAIR flow control valves, the calculated values of $Q_{SAIR2,1}$, $Q_{SAIR2,2}$, and $Q_{SAIR2}$ decrease to a lower level at time t1.

At time t1, the change in $Q_{SAIR}$, $\Delta Q_{SAIR}$ 644 is greater than a threshold change in $Q_{SAIR}$, $\Delta Q_{SAIR,TH}$ 642. Furthermore, a change in $Q_{SAIR,1}$ 630, $\Delta Q_{SAIR,1}$ is greater than a threshold change in $Q_{SAIR,1}$, $\Delta Q_{SAIR,j,TH}$ 631; similarly, a change in $Q_{SAIR,2}$ 636, $\Delta Q_{SAIR,2}$ is greater than a threshold change in $Q_{SAIR2}$, $\Delta Q_{SAIR,j,TH}$ 631. Furthermore, a difference between $Q_{SAIR2,1}$ and $Q_{SAIR2,2}$, $\Delta Q_{SAIR2,1,2}$ is less than a threshold difference, $\Delta Q_{SAIR2,j,j+1,TH}$ 633. Accordingly, the controller 12 determines that the SAIR degradation condition is not satisfied.

At time t2, the engine is switched OFF, and $T_{engine}$, $T_{ECD1}$, and $T_{ECD2}$ all begin to decrease, eventually decreasing below their respective threshold temperatures between times t2 and t3, $T_{engine,TH}$ and $T_{ECD,TH}$, respectively, as the engine and the exhaust stream cool. Between time t2 and time t3, the second condition remains satisfied, and $Q_{SAIR2,1}$, $Q_{SAIR2,2}$ and $Q_{SAIR2}$ remain at lower levels since the SAIR pump remains OFF and the SAIR flow control valves remain closed.

At time t3, the engine is cold started, and the engine status switches from OFF to ON. Responsive to the cold engine start, $T_{engine}<T_{engine,TH}$, $T_{ECD1}<T_{ECD,TH}$, and $T_{ECD2}<T_{ECD,TH}$, the controller 12 switches ON the SAIR pump and opens both of the SAIR flow control valves to direct SAIR to the exhaust manifolds downstream from both cylinder banks. Thus, at time t=0, the first condition is satisfied and the second condition is not satisfied. Between times t3 and t4, $T_{engine}$, $T_{ECD1}$, and $T_{ECD2}$ begin to increase as the vehicle 5 is operated and the engine 10 warms up. Responsive to the first condition being satisfied, controller 12 measures $Q_{inj,j}$, $Q_{air,intake}$, and $\lambda_j$, and begins estimating $Q_{SAIR1,1}$, $Q_{SAIR1,2}$ and $Q_{SAIR1}$. The calculated values $Q_{SAIR1,1}$, $Q_{SAIR1,2}$, and $Q_{SAIR1}$ increase. In particular, $Q_{SAUD1,1}$ increases to a higher level (similar to between times t=0 and t1), however, $Q_{SAIR1,2}$ just slightly increases, and $Q_{SAIR1}$ between times t3 and t4 is lower than $Q_{SAIR1}$ between times t=0 and t1.

At time t3, the change in $Q_{SAIR}$, $\Delta Q_{SAIR}$ 644 is less than the threshold change in $Q_{SAIR}$, $\Delta Q_{SAIR,TH}$ 642. Furthermore, a change in $Q_{SAIR,1}$ 630, $\Delta Q_{SAIR,1}$ is greater than the threshold change in $Q_{SAIR,1}$, $\Delta Q_{SAIR,j,TH}$ 631 ($\Delta Q_{SAIR,j,TH}$ refers to a threshold $j^{th}$ bank SAIR difference); however, a change in $Q_{SAIR,2}$ 636, $\Delta Q_{SAIR,2}$ is less than the threshold change in $Q_{SAIR2}$, $\Delta Q_{SAIR,j,TH}$ 631. Furthermore, a difference between $Q_{SAIR1,1}$ and $Q_{SAIR1,2}$, $\Delta Q_{SAIR1,1,2}$ is greater than a threshold difference, $\Delta Q_{SAIR,j,j+1,TH}$ 633. Accordingly, responsive to one or more of $\Delta Q_{SAIR}<\Delta Q_{SAIR,TH}$, $\Delta Q_{SAIR,2}<\Delta Q_{SAIR,2,TH}$, and $\Delta Q_{SAIR1,1,2}>t\Delta Q_{SAIR1,i,j+1,TH}$, the controller 12 determines that the SAIR degradation condition is satisfied. In particular, the controller 12 may generate an indication to the vehicle operator that the second cylinder bank is degraded. In the example of timeline 600, at time t3, because $Q_{SAIR,2}$ did not increase to a higher level with then SAIR pump was turned ON and when the SAIR flow control valves were opened, there may be a faulty SAIR flow control valve directing SAIR to the exhaust manifold downstream of the 2nd cylinder bank.

Between times t3 and t4, $T_{engine}$, $T_{ECD1}$, and $T_{ECD2}$ continue to increase as the vehicle 5 is operated and the engine 10 warms up. Furthermore, the first condition remains satisfied (and the second condition is not satisfied), and the values of $Q_{SAIR1,1}$, $Q_{SAIR1,2}$ and $Q_{SAIR1}$ are maintained.

Next, at time t4, the threshold duration since the engine cold start, $\Delta t_{start,TH}$ 691 is exceeded, the engine status remains ON, $T_{engine}$ increases beyond $T_{engine,TH}$, and both $T_{ECD1}$ and $T_{ECD2}$ increase beyond $T_{ECD,TH}$, each (individually or in combination) signaling end of the engine cold start event. Responsive to the end of the cold start event at time t4, controller 12 switches OFF the SAIR pump, and closes the SAIR flow control valves. As such, at time t4, the first condition is no longer satisfied, and the second condition is satisfied. Controller 12 continues to measure $Q_{inj,j}$, $Q_{air,intake}$, and $\lambda_j$, and estimates $Q_{SAIR2,1}$, $Q_{SAIR2,2}$ and $Q_{SAIR2}$ from equations (1) to (6). Responsive to the SAIR pump being switched OFF and closing of the SAIR flow control valves, the calculated values of $Q_{SAIR2,1}$, $Q_{SAIR2,2}$, and $Q_{SAIR2}$ all decrease to a lower level at time t4.

At time t4, the change in $Q_{SAIR}$, $\Delta Q_{SAIR}$ 644 is less than a threshold change in $Q_{SAIR}$, $\Delta Q_{SAIR,TH}$ 642. Furthermore, a change in $Q_{SAIR,1}$ 630, $\Delta Q_{SAIR,1}$ is greater than a threshold change in $Q_{SAIR,1}$, $\Delta Q_{SAIR,j,TH}$ 631; however, a change in $Q_{SAIR,2}$636, $\Delta Q_{SAIR,2}$ is less than a threshold change in $Q_{SAIR2}$, $\Delta Q_{SAIR,j,TH}$ 631. Furthermore, a difference between $Q_{SAIR2,1}$ and $Q_{SAIR2,2}$, $\Delta Q_{SAIR2,1,2}$ is less than a threshold difference, $\Delta Q_{SAIR1,j,j+1,TH}$ 633. Responsive to one or more of $\Delta Q_{SAIR}<\Delta Q_{SAIR,TH}$, and $\Delta Q_{SAIR,2}<\Delta Q_{SAIR,j,TH}$, the controller 12 determines that the SAIR degradation condition remains satisfied. At time t5, the engine is switched OFF, and $T_{engine}$, $T_{ECD1}$, and $T_{ECD2}$ all begin to decrease, eventually decreasing below their respective threshold temperatures after time t5, $T_{engine,TH}$ and $T_{ECD,TH}$, respectively, as the engine and the exhaust stream cool. After time t5, the second condition remains satisfied, and $Q_{SAIR2,1}$, $Q_{SAIR2,2}$ and $Q_{SAIR2}$ remain at lower levels since the SAIR pump remains OFF and the SAIR flow control valves remain closed.

In this manner, an engine system includes an engine cylinder, a secondary airflow (SAIR) pump, and a controller, including executable instructions stored in non-transitory memory thereon to, determine a degradation of a SAIR system delivering a SAIR downstream of an exhaust of the engine cylinder based on a comparison of the SAIR before and after a shutdown of a SAIR pump, the SAIR calculated from a fuel injection amount, an exhaust air-fuel ratio, and an engine intake airflow. In a first example of the engine system, the executable instructions further include, indicating the degradation of the SAIR system responsive to a difference between the SAIR before the shutdown of the SAIR pump and the SAIR after the shutdown of the SAIR pump being less than a threshold SAIR difference. In a second example, optionally including the first example, the engine system further includes first and second banks of engine cylinders, wherein the executable instructions further include, indicating the degradation of the SAIR system responsive to a difference between the SAIR from the first bank of engine cylinders and the SAIR from the second bank of engine cylinders being less than a threshold bank-bank SAIR difference. In a third example, optionally including one or more of the first and second examples, the engine system further includes first and second exhaust gas sensors, wherein the first and second exhaust gas sensors are positioned downstream of an exhaust from the first bank of engine cylinders and an exhaust from the second bank of engine cylinders, respectively, and wherein the executable instructions further include measuring the exhaust air-fuel ratio downstream from the first and second bank of engine cylinders with the first and second exhaust gas sensors, respectively. In a fourth example, optionally including one or more of the first through third examples, the engine system further includes first and second SAIR valves, wherein each of the first and second SAIR valves are positioned downstream from the SAIR pump and upstream of the first and second exhaust gas sensors, respectively, and wherein the executable instructions further include, indicating the degradation of at one of the first and second SAIR valves responsive to the difference between the SAIR from the first bank of engine cylinders and the SAIR from the second bank of engine cylinders being less than the threshold bank-bank SAIR difference. In a fifth example of the engine system, optionally including one or more of the first through fourth examples, the executable instructions further include, indicating the degradation of the first SAIR valve responsive to a difference between the SAIR from the first bank of engine cylinders before shutdown of the SAIR pump and the SAIR from the first bank of engine cylinders after shutdown of the SAIR pump being less than a threshold first bank SAIR difference.

In another representation of the engine system, optionally including one or more of the first through fifth examples, the executable instructions further include, wherein the comparison of the SAIR before and after the shutdown of the SAIR pump includes determining a SAIR ratio, the SAIR ratio calculated by dividing the SAIR before shutdown of the SAIR pump by the SAIR after shutdown of the SAIR pump. In another representation of the engine system, optionally including one or more of the first through fifth examples, the executable instructions further include, wherein the comparison of the SAIR before and after the shutdown of the SAIR pump includes determining a difference between a percent SAIR before the shutdown of the SAIR pump and a percent SAIR after shutdown of the SAIR pump, the percent SAIR calculated by determining the SAIR downstream of an engine cylinder exhaust divided by the exhaust airflow downstream of the engine cylinder exhaust.

In this way, a technical effect of monitoring and diagnosing a SAIR system, including determining the SAIR at the exhaust manifold can be achieved utilizing existing onboard sensors and technology, thereby maintaining OBD and emissions monitoring, reducing engine emissions, and maintaining vehicle manufacturing expenses.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for monitoring a secondary airflow (SAIR) system in an engine, comprising:

determining a degradation of the SAIR system adding a SAIR flow rate to downstream of an engine cylinder exhaust based on a comparison of the SAIR flow rate before and after a shutdown of a SAIR pump, the SAIR flow rate calculated from a fuel injection amount, an exhaust air-fuel ratio, and an engine intake airflow.

2. The method of claim 1, further comprising determining the degradation of the SAIR system responsive to a difference between the SAIR flow rate before the shutdown of the SAIR pump and the SAIR flow rate after the shutdown of the SAIR pump being less than a threshold SAIR difference.

3. The method of claim 1, further comprising determining the degradation of a the SAIR system responsive to a difference between the SAIR flow rate corresponding to a first bank of engine cylinders and the SAIR flow rate corresponding to a second bank of engine cylinders being greater than a threshold bank-bank SAIR difference.

4. The method of claim 1, further comprising determining the degradation of a SAIR valve directing the SAIR flow rate to a first bank of engine cylinders responsive to a difference between the SAIR flow rate from the first bank of engine cylinders before the shutdown of the SAIR pump and the SAIR flow rate from the first bank of engine cylinders after the shutdown of the SAIR pump being less than a threshold first bank SAIR difference.

5. The method of claim 1, further comprising measuring the exhaust air-fuel ratio downstream of the engine cylinder exhaust with an exhaust gas sensor, and calculating an exhaust airflow in the engine cylinder exhaust based on the exhaust air-fuel ratio and the fuel injection amount.

6. The method of claim 5, further comprising calculating the SAIR flow rate from a difference between the exhaust airflow in the engine cylinder exhaust and the engine intake airflow.

7. The method of claim 1, further comprising measuring the exhaust air-fuel ratio in an exhaust from each cylinder bank of the engine, calculating an exhaust airflow from each cylinder bank of the engine from the exhaust air-fuel ratio and the fuel injection amount delivered to each cylinder bank, and calculating the SAIR flow rate at the exhaust from each cylinder bank from a difference between the exhaust airflow from each cylinder bank and the intake airflow.

8. The method of claim 1, further comprising turning on the SAIR pump responsive to a cold start condition being met, including when a cold start engine event has occurred, and shutting down the SAIR pump responsive to the cold start condition not being met, the cold start condition not being met including when an engine temperature increases above a threshold engine temperature.

9. The method of claim 8, wherein the cold start condition not being met further includes when a threshold duration following the cold start engine event is exceeded.

10. An engine system, comprising an engine cylinder, a secondary airflow (SAIR) pump, and a controller, including executable instructions stored in non-transitory memory thereon to:

determine a degradation of a SAIR system delivering a SAIR flow rate downstream of an exhaust of the engine cylinder based on a comparison of the SAIR flow rate before and after a shutdown of the SAIR pump, the SAIR flow rate calculated from a fuel injection amount, an exhaust air-fuel ratio, and an engine intake airflow.

11. The engine system of claim 10, wherein the executable instructions further include indicating the degradation of the SAIR system responsive to a difference between the SAIR flow rate before the shutdown of the SAIR pump and the SAIR flow rate after the shutdown of the SAIR pump being less than a threshold SAIR difference.

12. The engine system of claim 10, further comprising first and second banks of engine cylinders, wherein the executable instructions further include indicating the degradation of the SAIR system responsive to a difference between the SAIR flow rate from the first bank of engine cylinders and the SAIR flow rate from the second bank of engine cylinders being less than a threshold bank-bank SAIR difference.

13. The engine system of claim 12, further comprising first and second exhaust gas sensors, wherein the first and second exhaust gas sensors are positioned downstream of an exhaust from the first bank of engine cylinders and an exhaust from the second bank of engine cylinders, respectively, and wherein the executable instructions further include measuring the exhaust air-fuel ratio downstream from the first and second bank of engine cylinders with the first and second exhaust gas sensors, respectively.

14. The engine system of claim 13, further comprising first and second SAIR valves, wherein each of the first and second SAIR valves is positioned downstream from the SAIR pump and upstream of the first and second exhaust gas sensors, respectively, and wherein the executable instructions further include indicating the degradation of one of the first and second SAIR valves responsive to the difference between the SAIR flow rate from the first bank of engine cylinders and the SAIR flow rate from the second bank of engine cylinders being less than the threshold bank-bank SAIR difference.

15. The engine system of claim 14, wherein the executable instructions further include indicating the degradation of the first SAIR valve responsive to a difference between the SAIR flow rate from the first bank of engine cylinders before shutdown of the SAIR pump and the SAIR flow rate from the first bank of engine cylinders after shutdown of the SAIR pump being less than a threshold first bank SAIR difference.

16. A method for an engine, comprising:

turning on a secondary airflow (SAIR) pump to direct intake air to a SAIR system responsive to a first condition being met, turning off the SAIR pump responsive to a second condition being met, and determining a degradation of the SAIR system based on a comparison of a SAIR flow rate at an exhaust manifold during the first condition and during the second condition, the SAIR flow rate calculated from a fuel injection amount, an exhaust air-fuel ratio, and an engine intake airflow.

17. The method of claim 16, wherein the first condition includes when the engine is cold started.

18. The method of claim 16, wherein the second condition includes when an engine temperature exceeds a threshold engine temperature.

19. The method of claim 16, wherein the second condition includes when a threshold duration following the engine being cold started elapses.

20. The method of claim 16, further comprising indicating the degradation of the SAIR system responsive to a difference between the SAIR flow rate during the second condition and the SAIR flow rate during the first condition being less than a threshold SAIR difference.

* * * * *